US009695030B2

(12) United States Patent
Walker

(10) Patent No.: US 9,695,030 B2
(45) Date of Patent: Jul. 4, 2017

(54) COLD BEVERAGE DISPENSER

(71) Applicant: BIBO Barmaid LLC, Clinton, NJ (US)

(72) Inventor: Debra L Walker, Clinton, NJ (US)

(73) Assignee: BIBO Barmaid LLC, Clinton, NJ (US)

( * ) Notice: Subject to any disclaimer, the term of this patent is extended or adjusted under 35 U.S.C. 154(b) by 47 days.

(21) Appl. No.: 14/806,522

(22) Filed: Jul. 22, 2015

(65) Prior Publication Data

US 2016/0023879 A1 Jan. 28, 2016

Related U.S. Application Data

(60) Provisional application No. 62/027,286, filed on Jul. 22, 2014.

(51) Int. Cl.
*B67B 7/46* (2006.01)
*B67D 1/00* (2006.01)
(Continued)

(52) U.S. Cl.
CPC ..... *B67D 1/0041* (2013.01); *B67D 1/0001* (2013.01); *B67D 1/0021* (2013.01);
(Continued)

(58) Field of Classification Search
CPC .. B67D 1/0041; B67D 1/0888; B67D 1/0001; B67D 1/0021; B67D 1/0078; B67D 1/0857; B67D 1/0046; B67B 7/24
(Continued)

(56) References Cited

U.S. PATENT DOCUMENTS 5,706,661 A * 1/1998 Frank ..... A23G 9/045 426/67
6,079,315 A 6/2000 Beaulieu et al.
(Continued)

FOREIGN PATENT DOCUMENTS

EP 0299767 A1 1/1989
IT WO 2016108148 A1 * 7/2016 ..... A23L 2/00
(Continued)

OTHER PUBLICATIONS

"Post Mix Soda Fountains", The CHI Company, New and Used Beverage Equipment for Honest Prices, Retrieved Date: Oct. 14, 2014, Retrieved At: <http://www.chicompany.net/index.php?main_page=index&cPath=25>, 3 pages.
(Continued)

*Primary Examiner* — Nicolas A Arnett
(74) *Attorney, Agent, or Firm* — Medley, Behrens & Lewis, LLC

(57) ABSTRACT

An apparatus for making a mixed drink includes a housing, a first single-serve beverage container, a second single-serve beverage container, an opening mechanism for opening the single-serve beverage containers, a chamber with an outlet, a water reservoir, and a pump. The first container holds a concentrate and the second container holds an alcohol. The chamber has an inlet for receiving the contents of the first and second containers and further includes an outlet. The water reservoir is positioned in the housing. The pump is coupled to the water reservoir for transferring water to the vicinity of the first and second containers. Water from the reservoir enters the chamber directly and/or through one or more of the containers.

17 Claims, 19 Drawing Sheets

(51) Int. Cl.
*B67D 1/08* (2006.01)
*B67B 7/00* (2006.01)

(52) U.S. Cl.
CPC ..... *B67D 1/0078* (2013.01); *B67D 1/0888* (2013.01); *B67B 7/24* (2013.01); *B67D 1/0046* (2013.01); *B67D 1/0857* (2013.01)

(58) Field of Classification Search
USPC ..... 141/9, 100, 105–107, 329–330
See application file for complete search history.

(56) References Cited

U.S. PATENT DOCUMENTS 6,606,938 B2 8/2003 Taylor
6,607,762 B2 8/2003 Lazaris et al.
6,655,260 B2 12/2003 Lazaris et al.
7,013,933 B2 * 3/2006 Sher ..... A23F 5/243 141/100
7,165,488 B2 1/2007 Bragg et al.
7,347,138 B2 3/2008 Bragg et al.
7,360,418 B2 4/2008 Pelovitz
7,377,162 B2 5/2008 Lazaris
7,398,726 B2 7/2008 Streeter et al.
7,490,638 B2 * 2/2009 Sher ..... A23F 5/243 141/100
7,513,192 B2 4/2009 Sullivan et al.
7,640,845 B2 1/2010 Woodnorth et al.
8,091,735 B2 1/2012 Girard et al.
8,104,642 B2 1/2012 Bambrick et al.
8,151,694 B2 4/2012 Jacobs et al.
8,361,527 B2 1/2013 Winkler et al.
8,495,949 B2 7/2013 Tinkler et al.
8,516,948 B2 8/2013 Zimmerman et al.
8,573,114 B2 11/2013 Huang et al.
8,590,753 B2 11/2013 Marina et al.
8,609,170 B2 12/2013 Tinkler et al.
8,667,892 B2 3/2014 Cominelli et al.
8,708,195 B1 4/2014 Duran
8,740,020 B2 6/2014 Marina et al.
8,757,222 B2 6/2014 Rudick et al.
8,808,775 B2 8/2014 Novak et al.
8,881,948 B1 11/2014 Lassota
8,989,895 B2 * 3/2015 Holman ..... G07F 17/0064 700/233
2006/0118581 A1 6/2006 Clark
2008/0314927 A1 12/2008 Martin
2009/0057340 A1 3/2009 Moothart
2009/0120961 A1 5/2009 Dietschi et al.
2010/0116842 A1 5/2010 Hecht et al.
2010/0154919 A1 6/2010 Jansen
2010/0269707 A1 10/2010 Wiemer et al.
2011/0017776 A1 * 1/2011 Metropulos ..... B67D 1/0888 222/129.1
2011/0166910 A1 7/2011 Marina et al.
2011/0226343 A1 9/2011 Novak et al.
2012/0183657 A1 7/2012 Marina et al.
2013/0015206 A1 1/2013 van Haperen et al.
2013/0042941 A1 2/2013 van Haperen et al.
2013/0054257 A1 * 2/2013 Holman ..... G07F 17/0064 705/2
2013/0068109 A1 * 3/2013 Pribus ..... A47J 31/46 99/295
2013/0071532 A1 * 3/2013 Pribus ..... A47J 31/46 426/431
2013/0189400 A1 * 7/2013 Pribus ..... B65D 85/8043 426/115
2013/0233180 A1 9/2013 Belmont
2013/0340626 A1 * 12/2013 Oh ..... B65D 85/8043 99/295
2014/0069953 A1 3/2014 Metropulos et al.
2014/0072678 A1 3/2014 Jenkins
2014/0106048 A1 4/2014 Harper
2014/0114469 A1 4/2014 Givens et al.
2014/0134299 A1 5/2014 Guidorzi et al.
2014/0175125 A1 6/2014 Breault
2014/0209634 A1 7/2014 Metropulos et al.
2014/0224130 A1 8/2014 Castellani et al.
2014/0263407 A1 9/2014 Rudick et al.
2014/0263414 A1 9/2014 San Miguel et al.
2014/0372233 A1 12/2014 Knecht et al.
2015/0079240 A1 * 3/2015 Lo Foro ..... A47J 31/401 426/115
2015/0125586 A1 5/2015 Ergican
2015/0135965 A1 * 5/2015 Lo Foro ..... A47J 31/407 99/285
2015/0144001 A1 * 5/2015 Lo Foro ..... A47J 31/407 99/283

FOREIGN PATENT DOCUMENTS

RU 69850 U1 1/2008
WO 2004075702 A1 9/2004
WO 2008104751 A1 9/2008

OTHER PUBLICATIONS

"International Search Report and Written Opinion for PCT/US2015/041632", Mailed Date: Oct. 29, 2015, 7 pages.
"International Preliminary Report on Patentability for PCT Patent Application No. PCT/US2015/041632", Mailed Date: Jan. 24, 2017, 5 pages.

* cited by examiner 14
52
58
60
54
56
46
18
24
16

52
54
46
14
12
26
44
18
24
40
42
54

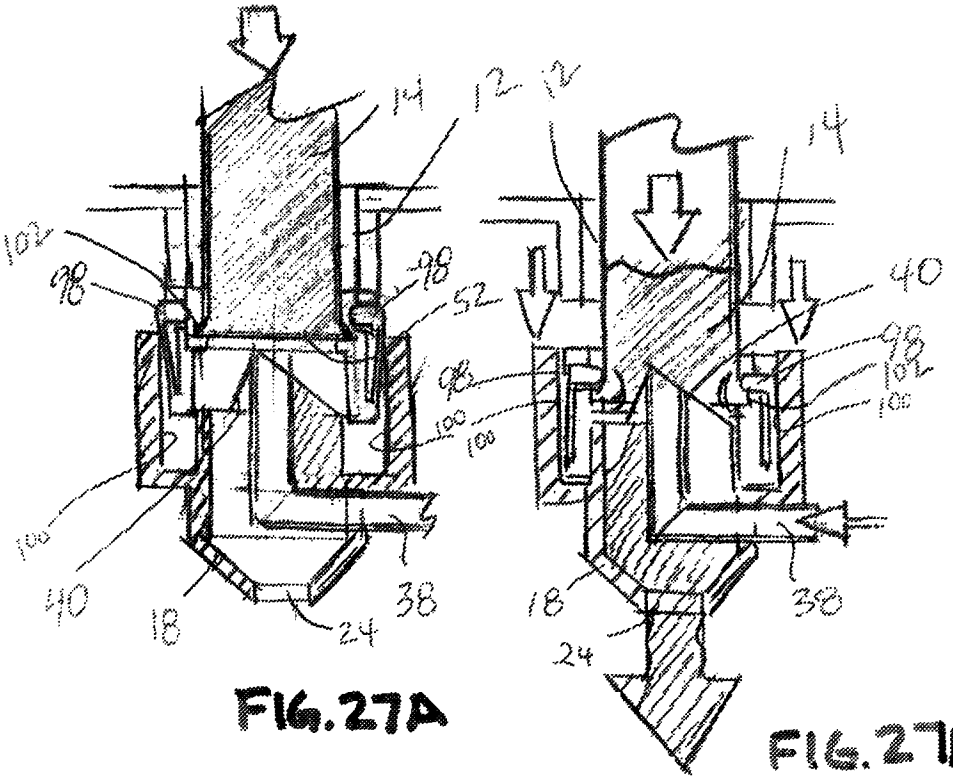
FIG. 27A
FIG. 27B
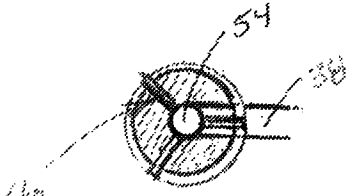
FIG. 26

COLD BEVERAGE DISPENSER

CROSS-REFERENCE TO RELATED APPLICATION

This application claims priority to U.S. Provisional application No. 62/027,286, filed on Jul. 22, 2014, the disclosure of which is incorporated herein by reference in its entirety.

FIELD

The examples described herein relate to a cold beverage dispenser for use in making mixed drinks and/or health and wellness drinks.

BACKGROUND

Many consumers enjoy trying different alcoholic beverages. Often, in order to try multiple types of beverages, it is necessary to purchase a multitude of ingredients and multiple bottles of alcohol. This is often very costly and requires a significant amount of storage, since bottle are often not emptied and need to be stored. Because of this, consumers tend to stick with a certain type of drink. Countertop coffee makers have become very popular among consumers. These countertop coffee makers include a brewer which heats water from a reservoir and inputs hot water to a single serve container that houses coffee grinds and a filter. Coffee is "brewed" in the container and then permitted to exit the brewer into a cup.

SUMMARY

A cold beverage dispenser is shown and described.

BRIEF DESCRIPTION OF THE DRAWINGS

FIG. 12 C is an alternative embodiment showing opening of the container occurring on the bottom surface of the container;

FIG. 26 depicts a schematic view of an alternative opening mechanism;

FIG. 27A depicts a cross-sectional view of an alternative receptacle design for dispensing ingredients from a container; and FIG. 27B depicts a cross-sectional view of the alternative receptacle design of claim 27A with the container being engaged with the container.

DETAILED DESCRIPTION

Figure 1:
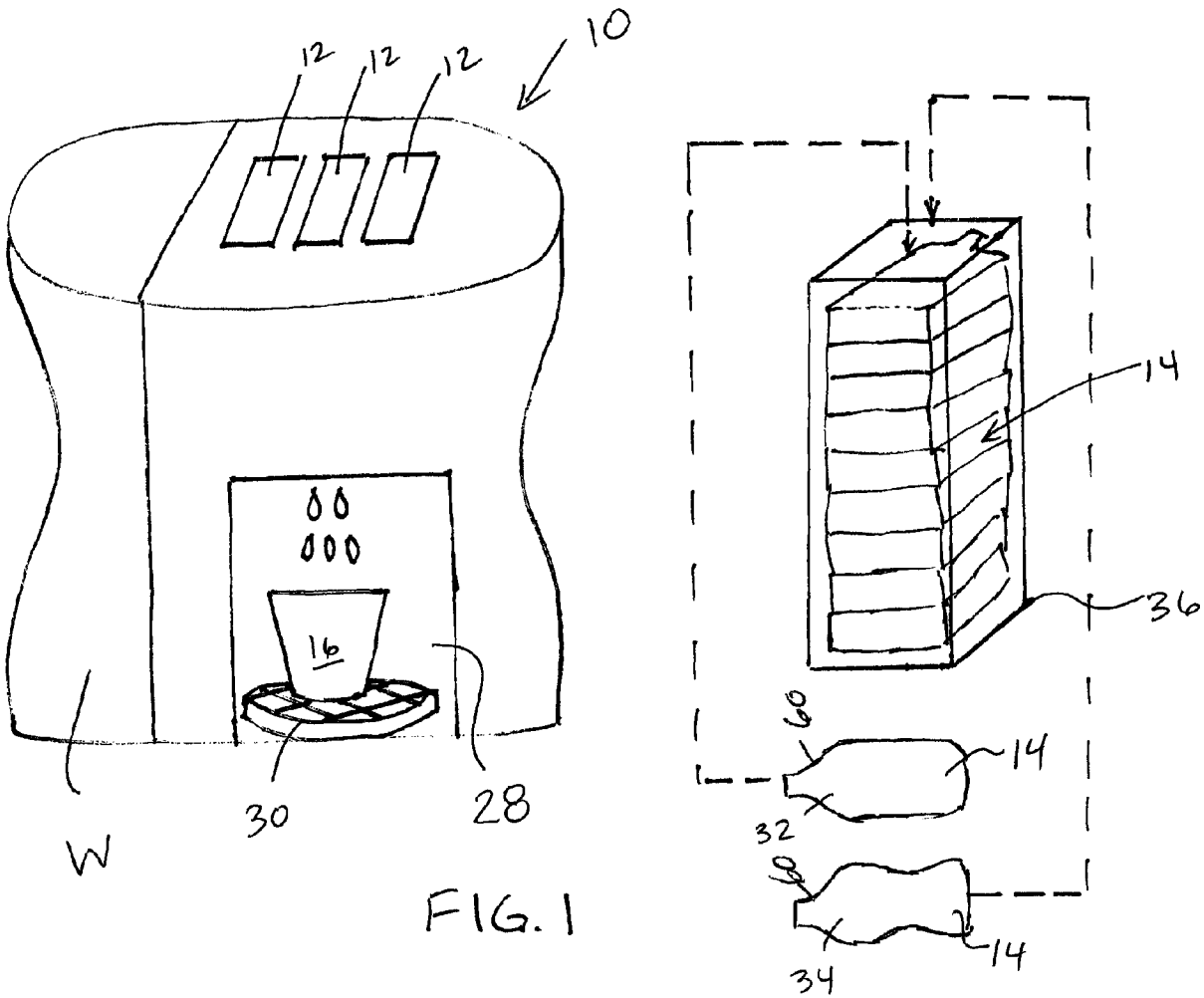
FIG. 1 shows an example beverage maker according to the invention, as well as a depiction of a beverage cartridge/container.

Consumers enjoy trying mixed drinks. Drink specialty menus are very popular at most restaurants. However, specialty drinks are often expensive to purchase. Consumers often would like to try specialty drinks at home, but it can be costly to purchase all the ingredients. In addition, consumers need to find recipes on their own. The cold beverage dispenser 10 described herein provides a solution for consumers to be able to make many different kind of drinks, including specialty drinks, without having to find a recipe and mix various ingredients together. The example dispenser described herein allows a consumer to make a "perfect" drink every time without having to buy multiple bottles of ingredients and alcohol.

In one example, the device 10 is an on-the-counter machine targeted to the casual cocktail market for people who want to try a variety of drinks, but don't necessarily want to invest in large amounts of expensive ingredients. In this example, the machine 10 is single-serve and permits a consumer to mix a wide variety of ingredients together to make a cocktail. The machine 10 has between 2 and 4 receptacles 12 for receiving ingredient containers 14, as well as a reservoir W for holding water. The receptacles 12 are configured to accept single serve containers 14 that include liquid ingredients. Alternatively, the containers 14 could hold powder ingredients. By utilizing multiple containers 14 in multiple receptacles 12, the consumer has the ability to create hundreds of cocktails. The containers 14 may include cocktail mixers (such as juice and other ingredients) or alcohol products (such as vodka, gin, whiskey, and the like). A typical cocktail can be made using one alcohol container 14 and one mixer container 14. The containers 14 are input separately into the receptacles 12 in the dispensing machine 10 and the alcohol is typically not mixed with the mixers prior to activation of the dispensing machine 10, although there may be some formulations where alcohol is mixed with a mixer in the container 14. The size of the containers 14 may vary relative to the alcohol pouches and relative to what is required in order to make a drink recipe. Although an initial embodiment of the beverage maker 10 is an on the counter-type device, the device 10 may alternatively be an on-the-floor device or have different sizes depending upon the application.

The containers 14 are formulated so that they allow the consumer to make the "perfect" drink every time because the mixers are proportioned to exactly match the amount of alcohol in the alcohol container 14. This allows the consumer great ease to try a variety of drinks, mixed perfectly, in their own home. No measuring of ingredients is needed. The consumer only has to insert the containers 14 into the receptacles 12 and let the machine 10 prepare the cocktail.

The Alcohol and Tobacco Tax and Trade Bureau (TTB) regulates the labeling, advertising and marketing of alcoholic beverages in the United States. Wine and liquor may only be sold in standard sizes. The smallest size bottle of distilled spirits permitted to be sold in the United States is referred to as a miniature and has a size of 50 ml or 1.7 ounces. A typical shot that is dispensed in US bars is between 1 ounce and 1.5 ounces. The "shot" dispensed in connection with the subject dispenser 10 is 1.7 ounces in order to conform to US sizing standards. This may change over time if federal regulations change. Other sizes may be used in other jurisdictions, with the size of the "shot" not being limited to 50 ml. The mixers utilized with the dispensing device 10 are formulated for use with 1.7 ounces of liquor. If a different size "shot" is permitted to be sold, then the mixers can be adjusted based upon the quantity of alcohol in the "shot" container. Double shots of alcohol may be used by either using a larger container 14 in the receptacle 12 or by using two alcohol containers 14, each having 1.7 ounces of alcohol. In one example, the dispenser 10 may have the capacity to make a "double" so that 3 ounces of alcohol are used at minimum, along with about 8 oz. of mixer. Alcohol may be dispensed as a precisely measured mixologist bartender shot, if desired and permitted under local laws.

The example drink dispenser 10 takes multiple containers 14 of material, adds water and dispenses them into a cup 16. The device 10 may include a funnel 18, mixing chamber 20, or, alternatively, the ingredients may simply flow directly into an underlying cup 16. A funnel 18 may be used in order to direct the ingredients into the underlying cup 16 while a mixing reservoir 20 will typically have a valve 22 positioned at its outlet in order to allow mixing of ingredients in the mixing reservoir 20 before the valve 22 is opened. Both the funnel 18 and the mixing chamber 20 have an outlet 24 through which the combined ingredients may exit the mixing chamber 20 or funnel. When a mixing chamber 20 is utilized, swirling motion created by the input of water may permit the ingredients to mix.

In yet another embodiment, a motorized blender (not shown) may be utilized to receive the ingredients and water in place of the mixing reservoir 20 so that the ingredients can be blended together before being dispensed into a cup 16. The blender may have an outlet 24 that is closed and opened by a valve 22 in order to permit blending in the blender before dispensing.

The dispensing device 10 may alternatively be used to make health drinks, such as those that include nutritional supplements or other "health food" related components. One type of ingredient may be a mixture of vitamins in a concentrated liquid form, which are known to be more readily absorbed by the body. Alternatively, a powder-based mix may be used, with water from a water supply W being used to make the mixture flow through the system 10. Other types of health enhancing products may be used including vitamins, minerals, and other nutrients or products, as known by those of skill in the art. Pureed fruits and vegetables may be utilized to incorporate fruits and vegetables, if desired. For example, a kale-based container 14 could be used along with a mango-based container 14 along with a supplement container 14. Juices may be used. This permits the user to customize their "health" drink to find a drink mixture that they enjoy.

The device 10 may have a refrigeration component or chiller (not shown) and may include an ice dispenser (not shown). Alternatively, ice may be added to the cup or glass 16 before or after the liquid mixture is dispensed into the cup/glass 16. The liquid mixture may also be dispensed into other types of receptacles, such as pitchers or mugs, for example (not shown). A chiller could be used to chill the water or the ingredients in the containers 14.

An exterior view of an example dispensing device 10 is shown in FIG. 1. The example dispensing device 10 has a reservoir for holding water W. Three receptacles 12 are shown positioned on a top surface 26 of the dispensing device 10. An opening 28 is shown in the side of the device 10 for accepting a cup 16 and a drip tray 30. Liquid is dispensed from the interior of the device 10 into the cup 16. FIG. 1 also shows two possible container shapes, one of which is bottle shaped 32 and the other of which is hourglass shaped 34. The container 14 may be stored in a box or other storage device 36, such as a clear plastic storage box, among other known storage devices 36. While not shown, the storage device 36 may include a slot along the side that permits the user to easily remove containers 14 from the storage device 36. Container 14 may enter the storage device 36 via an opening in the top, as one example. Other examples are readily known by those of skill in the art.

FIGS. 2A-2E represent different possible variations for dispensing from the containers 14 and water introduction into the system 10. The examples presented are non-exhaustive. Other variations are also possible and would be recognized by those of skill in the art. The dispensing device 10 has a water reservoir W or other water source. A fluid line 38 is coupled to the water reservoir W and a pump P. The fluid line 38 communicates with the containers 14 in order to mix water with the ingredients of the containers 14. Two containers 14 are shown, but more than two containers 14 may be used if desired.

FIGS. 2A-2C and 2E represent a direct deposit method of depositing the liquid into a cup 16 16. In these embodiments, liquid enters a funnel shaped member 18 and is deposited directly into the cup 16 that is positioned under an opening 24 in the bottom of the funnel 18. While a funnel shape is shown, other shapes may be used as long as they permit all the liquid to travel out of the dispensing device 10 and provide a function of a funnel. A controller C is shown coupled to the pump P in order to regulate the flow of water from the pump P to the funnel 18 or to the containers 14. A controller C could also be used for opening and closing valves 22, or for moving an opening mechanism 40, such as a piercer into position, among other functions.

Figures 2A, 2B, 2C:
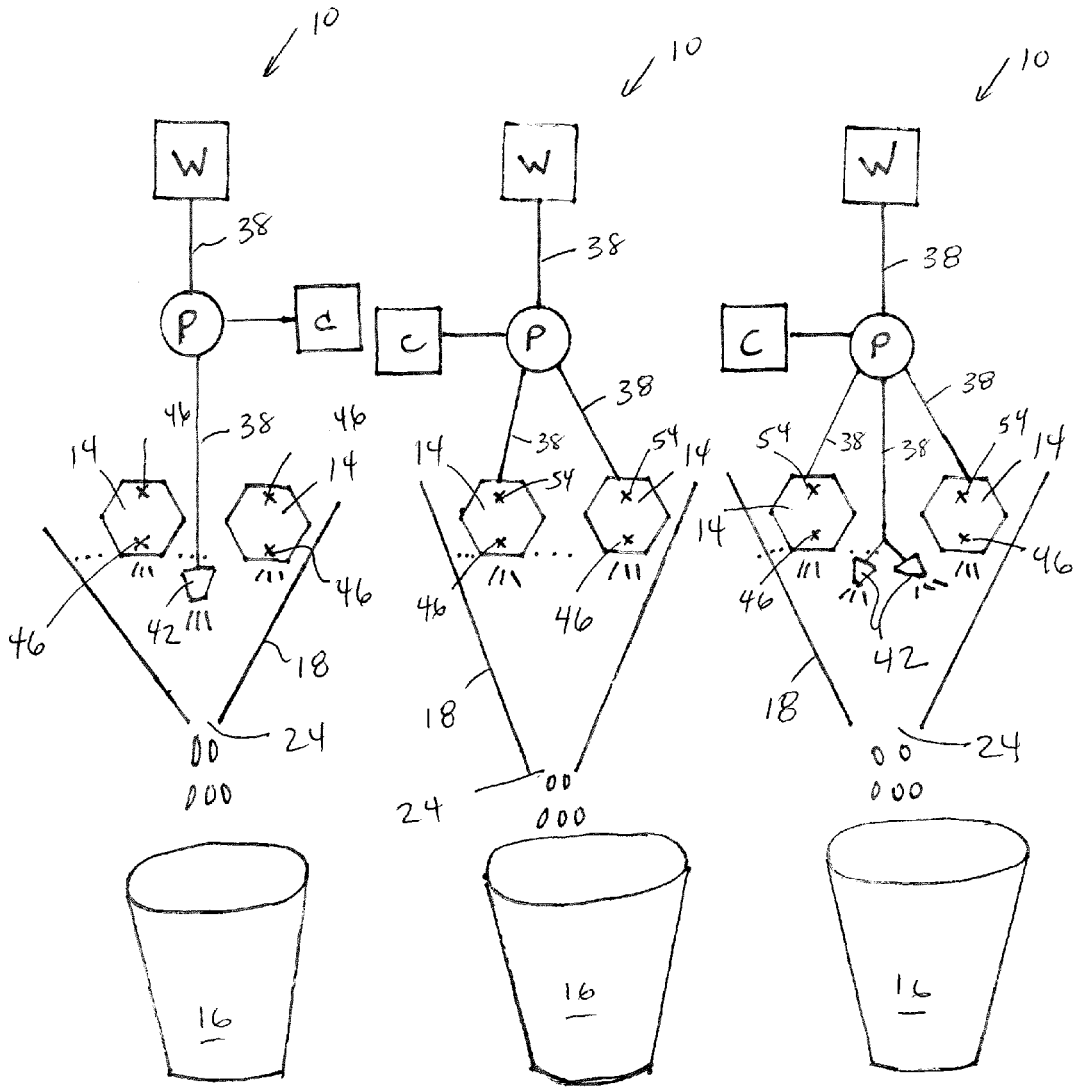
FIG. 2*a* depicts a schematic of a first example dispenser according to the invention.
FIG. 2*b* depicts a schematic of a second example dispenser according to the invention.
FIG. 2*c* depicts a schematic of a first example dispenser according to the invention.

FIG. 2A depicts a system 10 where the liquid in the containers 14 flows from the containers 14 into the funnel 18 while liquid from the water source W is pumped via the pump P into the funnel 18. The water can be directed in any manner desired, such as in a swirling pattern to assist in cleaning the funnel 18. Water may be sprayed through a nozzle 42, if desired, or may simply be deposited from a water line 38. Liquid can exit the containers 14 by gravity or squeezing.

FIG. 2B is similar to FIG. 2A except the water from the pump P is directed into the containers 14 in order to wash the interior of the containers 14 so that all liquid exits the containers 14 and flows into the funnel 18.

FIG. 2C is similar to FIGS. 2A and 2B. Water flows from the water source W though both containers 14 and through nozzles 42 that are positioned in the funnel 18 in order to wash the funnel 18 before the liquid enters the cup 16.

Figure 2D:
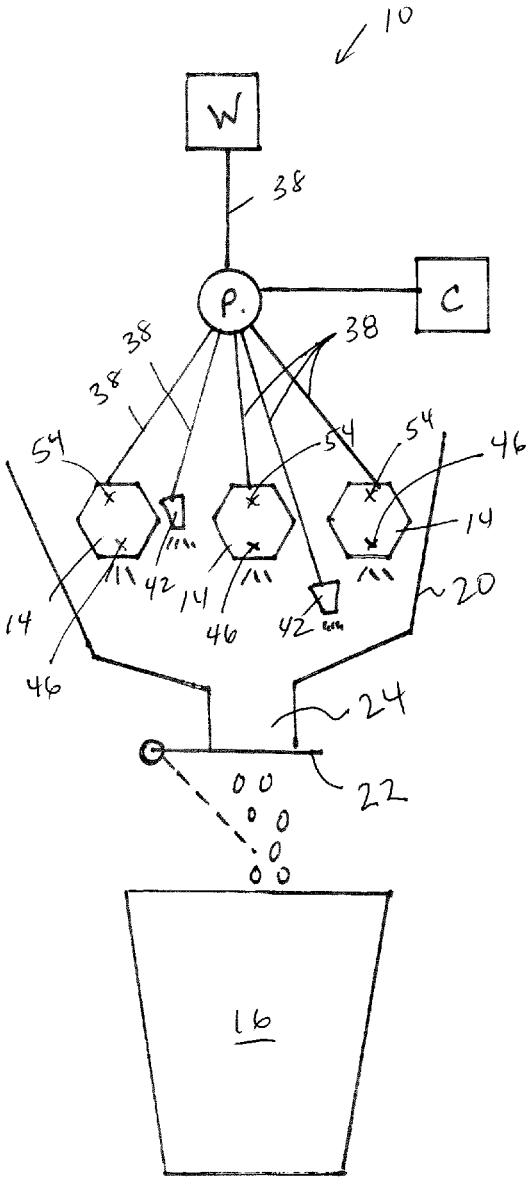
FIG. 2*d* depicts a schematic of a first example dispenser according to the invention.

FIG. 2D depicts an alternative embodiment that has three containers 14. The containers 14 communicate with the water source W to receive water into each of the containers 14. In addition, the pump P pumps water into the reservoir 20. As shown, the water is ejected from nozzles 42 at different locations within the reservoir 20. In this embodiment, a closed reservoir 20 is utilized to permit mixing of ingredients before the ingredients are deposited in a cup 16. A valve 22 is positioned at the opening of the reservoir 20. After all the liquid has entered the reservoir 20, the valve 22 opens to permit the ingredients and water to flow into the cup 16. The reservoir 20 could alternatively be a blender or mixer.

Figure 2E:
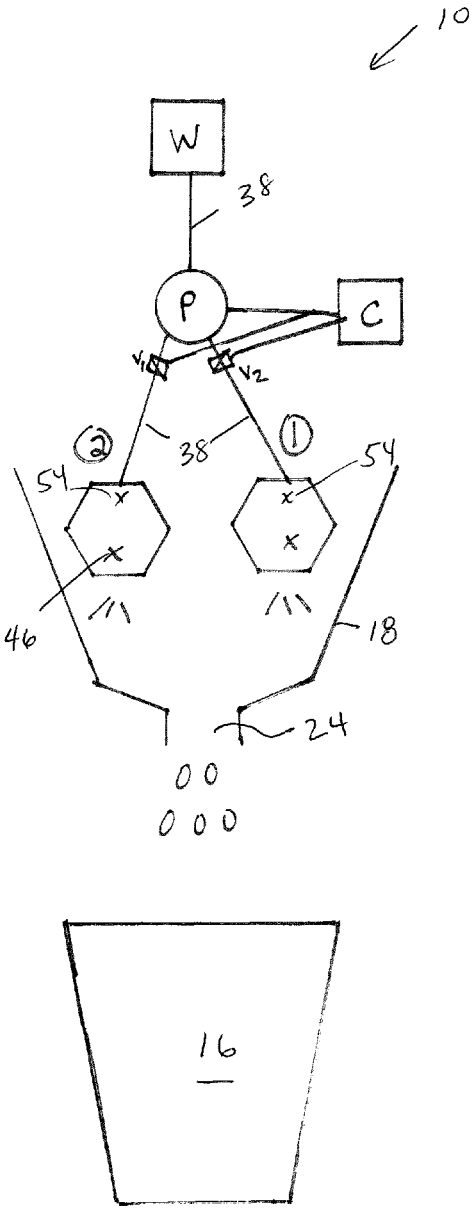
FIG. 2*e* depicts a schematic of a first example dispenser according to the invention.

FIG. 2E is similar to FIG. 2B, but involves sequencing of the water flow in order to allow water to first flow through container No. 1 14, which has the cocktail mixer, and then to flow through container No. 2 14, which has the alcohol product. This permits the alcohol to wash the interior of the funnel 18 on its way out. Valves 22 may be utilized in the fluid lines 38 to open and close the lines during the sequencing. Alternatively, the pump P can include valves for allowing water to pass through one line at a time. Other techniques are known for sequencing and could be utilized, as well.

FIGS. 3A-3D depict the use of a container 14 in the form of an aseptic bag or lamination pouch that is used to hold the ingredients. This type of bag is readily known in the packaging industry and is used for such things as juice boxes and other liquids. A first container 14 holds the alcohol and a second container 14 holds the cocktail mixer. While not shown, the containers 14 will be positioned in a receptacle 12 in FIG. 3A. The containers 14 shown are bottle shaped and the neck of the bottle is shown facing downwardly when installed in the receptacle 12. Other shapes could be utilized. For example a shape that is not direction specific could be used, if desired, such as a round, oval, rectangular, or other shaped pouch.

Figures 3A, 3B, 3C, 3D, 4A, 4B:
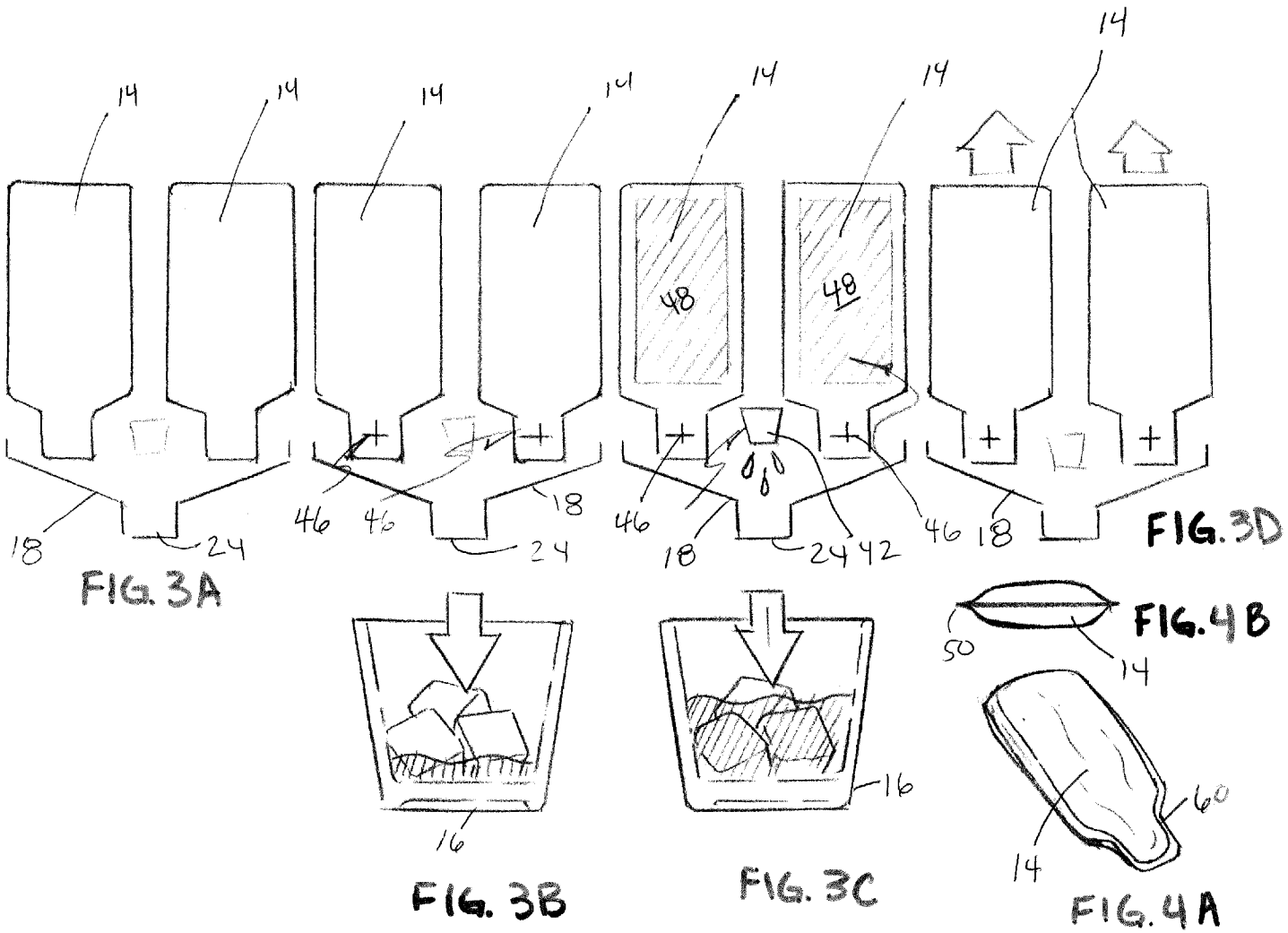
FIG. 3A depicts a schematic of dispensing according to FIG. 2A, 2C or 2E representing positioning the containers in the dispensing device.
FIG. 3B depicts a schematic of dispensing that occurs after FIG. 3A that involves piercing or opening the containers.
FIG. 3C depicts a schematic of dispensing that occurs after FIG. 3B representing dispensing the ingredients into a glass.
FIG. 3D depicts a schematic of dispensing that occurs after FIG. 3C representing removing the containers from the dispensing machine.
FIG. 4A depicts a perspective view of a first example container in the form of a flexible pack.
FIG. 4B depicts an end view of the flexible pack of FIG. 4A.

In this example, the containers 14 are loaded into the device 10 in FIG. 3A. The container 14 is loaded into the receptacle 12 by hand. Then a closing mechanism 44, such as a button, lever, paddle, or other mechanism, is used to close the receptacle 12 and to dispense the contents from the containers 14. Once the containers 14 are positioned in the device 10, a cup 16 is positioned below a funnel 18 that receives liquid from the containers 14. Then an opening mechanism 40, such as a puncturing mechanism, is used to make an opening in the container 14. An opening 46 is shown being made near the bottom, front of the pouch 14, but could be made at other locations, such as at the end, rear, or side. Some of the contents of the containers 14 may exit the container 14 upon contact of the container 14 with the opening mechanism 40. In some cases, the ingredients in the containers 14 will freely flow substantially entirely out of the containers 14 by gravity. This will in part depend upon the viscosity of the ingredients as well as the size of the opening 46 made in the containers 14 with the opening mechanism 40. In some cases, it may be beneficial to squeeze the contents of the containers 14 to ensure that the containers 14 are fully evacuated. This can be done at either FIG. 3B or FIG. 3C. Squeezing may occur by using pressure from the closing mechanism 44, or by using rollers (not shown), which are also typically applied with the closing mechanism 44.

FIG. 3B shows a cup 16 placed under the funnel 18 so that when the opening mechanism 40 opens the containers 14, the liquid can fall through the opening in the funnel 18 into the cup 16. FIG. 3C shows the introduction of water into the funnel 18 for mixing with the ingredients from the containers 14. The spray from the water nozzle 42 can be directed, if desired, to make a swirling pattern in order to clean the funnel 18 after the ingredients have been emptied into the funnel 18. The spray from the water nozzle 42 can also be directed at the opening mechanism 40 in order to clean the opening mechanism 40. Multiple ports or nozzles 42 may be used for introducing water into the funnel 18.

FIG. 3C also shows a squeezing zone 48, which is a location on the containers 14 where pressure can be applied to the containers 14 by the closing mechanism 44 in order to squeeze the contents from the containers 14. Then the closing mechanism 44 is closed in FIG. 3B, forcing the contents of the containers 14 to empty. FIG. 3D shows that the containers 14 can then be removed from the dispensing device 10 by pulling them out at their top end. The funnel 18 may be removable for cleaning, if desired. The squeezing zone 48 could have a different shape from that shown and could encompass the entire surface of the container 14.

FIGS. 4A and 4B depict the example container 14 shown in FIGS. 3A-3D. As discussed above, the container 14 is a bag or pouch that has a center seam 50. The seam 50 may be positioned in other locations if desired. Advertising indicia may be positioned on an exterior surface of the bag, if desired (not shown).

FIGS. 3A-3D depict the containers 14 being positioned side-by-side. However, if desired, the containers 14 could be stacked against one another, or be positioned back-to-back (not shown). In the example shown in FIGS. 3A-3D where the containers are stacked instead of positioned side-by-side, a single opening mechanism 40 could be used to open both containers 14. Alternatively, multiple opening mechanisms 40 could be used, one on either side. Stacking of the containers 14 may also make the form factor of the device 10 smaller.

Figures 5A, 5B, 5C, 6A, 6B:
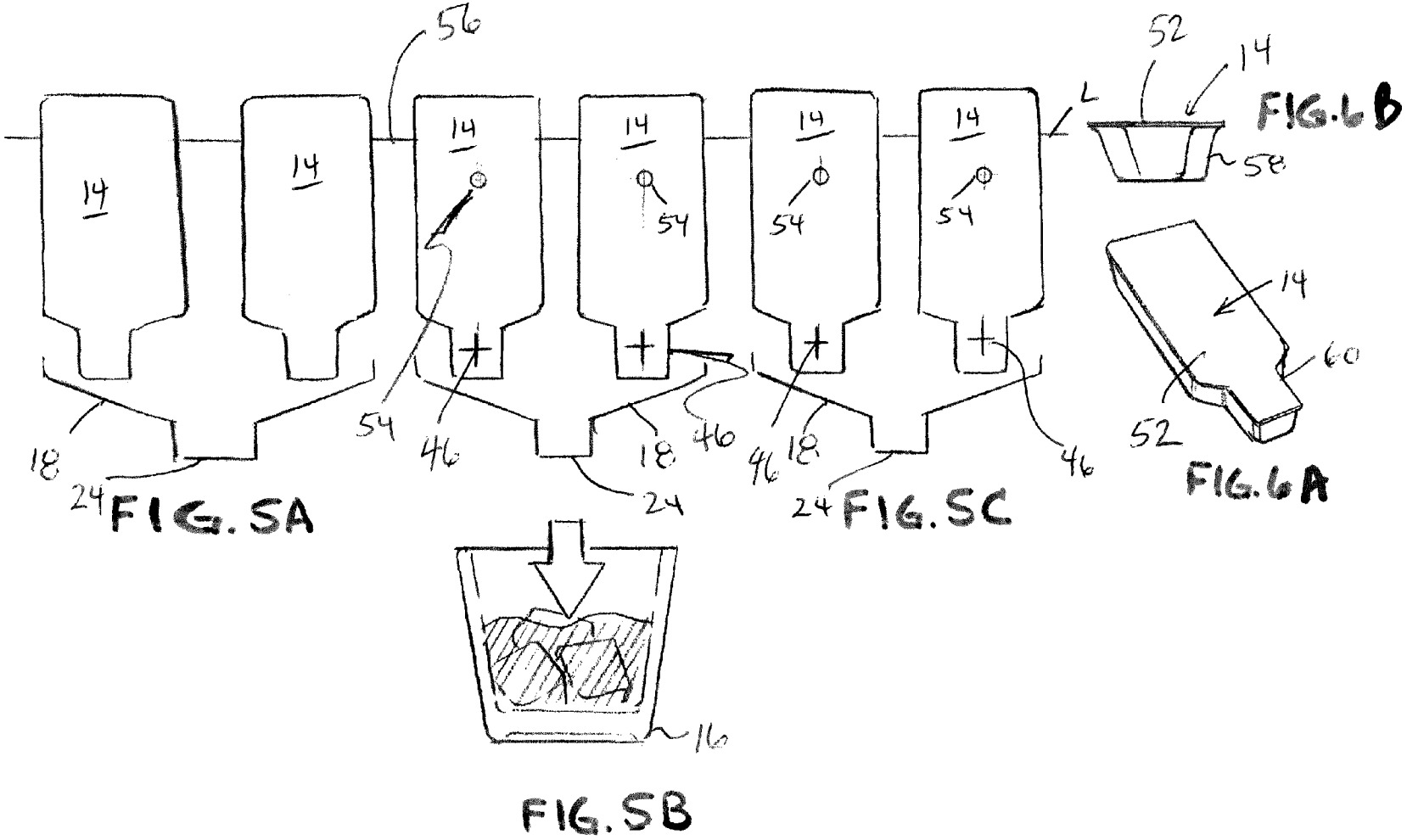
FIG. 5A depicts a schematic of dispensing according to FIG. 2B or 2E representing positioning the containers in the dispensing device.
FIG. 5B depicts a schematic of dispensing that occurs after FIG. 5A that involves piercing or opening the containers and dispensing the ingredients into a glass.
FIG. 5C depicts a schematic of dispensing that occurs after FIG. 5B representing removing the containers from the dispensing machine.
FIG. 6A depicts a perspective view of a second example container in the form of a thermoformed pack that is sealed with a foil cover.
FIG. 6B depicts an end view of the thermoformed pack of FIG. 6A.

FIGS. 5A-5C depict another dispensing method that utilizes a thermoformed container 14 that has a foil seal or liner 52 on one side of the container 14, as shown in FIGS. 6A and 6B. FIG. 5A depicts positioning the containers 14 in the device 10 by hand so that the leading end of the containers 14 are positioned near the funnel 18. While the containers 14 are shown as being positioned side-to-side, they could alternatively be positioned back-to-back, or stacked. After loading the containers 14 into the device 10, a closing mechanism 44 may be used for closing the device 10, such as a button, lever or paddle, among other closing mechanisms. Upon closing, the opening mechanism 40 engages the liners 52 on the containers 14 in order to open the containers 14. The opening mechanism 40 cuts open the liner 52 near the bottom end/leading end in order to allow liquid to drain from the container 14. In addition, a water inlet 54 from a water source W may puncture the liner towards a top end of the liner in order to introduce water into the interior of the containers 14 in order to "wash" the interior to fully utilize all or substantially all the ingredients inside the container 14. Water may continue to run through the container 14 even after the fluid in the container 14 has been removed from the container 14 such that clean water runs through the funnel 18 at the end of the dispensing process. While not shown, water could also be dispensed directly into the funnel 18 to aid in washing the funnel 18 and in order to add more water to the mixture.

The opening mechanism 40 and the water inlet 54 may puncture the liner at substantially the same time, or one may puncture before the other. A controller C or processor can be used to sequence the opening of a valve in order to introduce water into the containers 14. A controller C or processor could also be used to close the containers 14 in the receptacles 12 and to move the opening mechanism 40 and the water inlet 54 towards and into the container 14, if desired. Alternatively, some of these functions can be done by hand. The pierced opening 46 is shown in FIGS. 5B-5C to occur on only one side of the container 14. It is possible for the pierced opening 46 to occur on both sides, with the puncture 46 at the bottom of the container 14 being on the liner side and the water inlet 54 puncturing on the opposite side and vice versa.

The water inlet 54 may include a puncturing mechanism 40 or the water inlet 54 may be positioned directly adjacent a puncturing mechanism 40 in order to puncture the container 14. The puncturing mechanism 40 is designed in order to properly puncture the container 14 based upon the thickness and type of material used for the surface of the container 14. FIG. 5B shows the ingredients from the containers 14 being dispensed into a glass 16 after being deposited onto the funnel 18. The funnel 18 has a central opening 24 to deposit directly into an underlying glass 16. The opening 24 could be non-centrally located, if desired. FIG. 5C shows the containers 14 being substantially emptied and ready for removal. The upper area of the containers 14, above Line L shows that part of the containers 14 extend above a surface of the housing 56 in order to make it easier for the consumer to grab and pull the containers 14 from the housing 56.

FIGS. 6A and 6B show a thermoformed container 14 that has a vacuum sealed liner 52 on one side thereof. The thermoformed container 14 can be made of PET, Polypropylene, Polystyrene, PETG, Surlyn, and HDPE food-grade materials or other materials. The seal 52 could be a foil seal or could be other types of materials, including any number of polymeric materials or combinations of materials in layers. The liner may comprise a combination of materials in layers, or could be a non-foil seal. The container 14 shown in FIGS. 6A and 6B has sloped side walls 58 and a flat bottom and top surface. The container 14 has a necked down portion 60 that suggests the shape of a bottle. Other sizes and shapes could be used. The seal 52 can be hermetic in order to preserve product freshness and shelf life and have inner layers that promote freshness and shelf life. While the liner is described as being vacuum sealed, it could be applied in other manners as known by those of skill in the art.

Figures 7A, 7B, 7C, 7D:
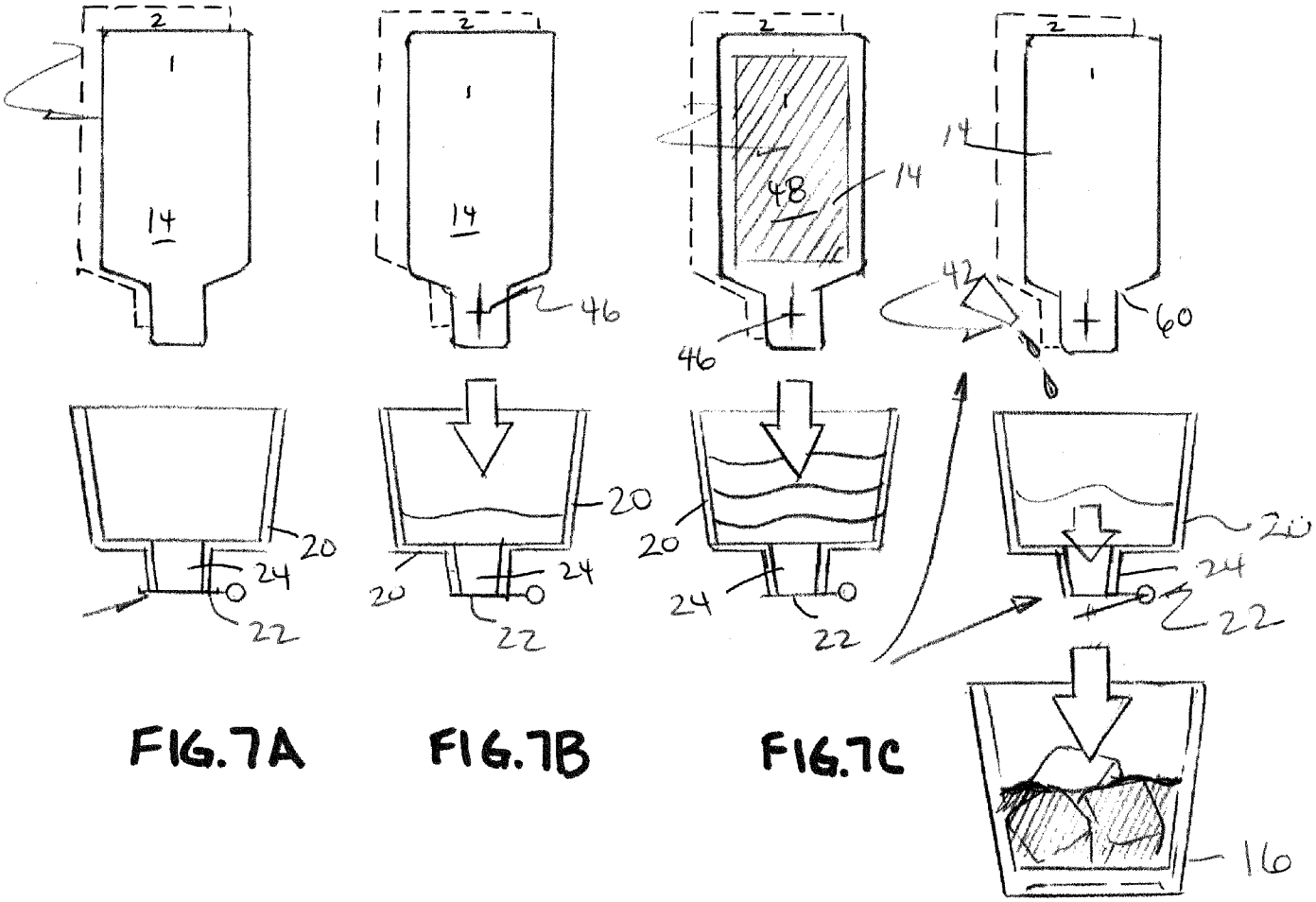
FIG. 7A depicts a schematic of dispensing according to FIG. 2D, with the containers being positioned in the dispensing device.
FIG. 7B depicts a schematic of dispensing that occurs after FIG. 7A where the contents of the containers are deposited into a closed reservoir.
FIG. 7C depicts a schematic of dispensing that occurs after FIG. 7B where all the contents of the containers have been deposited into the closed reservoir.
FIG. 7D depicts a schematic of dispensing that occurs after FIG. 7C showing water being added to the reservoir and the valve to the reservoir being opened to dispense the ingredients into a cup.

FIGS. 7A-7D depict an alternative embodiment where the container 14 is a bag, similar to that shown in FIGS. 4A and 4B. A single container 14 could be used, or multiple stacked containers 14 could be used at a single time. The design includes a reservoir 22 instead of a funnel 18, with the reservoir being closed by a valve 22. The reservoir 20 is shown having a flat bottom, but could have a sloped bottom to promote the transfer of fluids from the reservoir outlet 24. FIG. 7A shows the container 14 or containers 14 being positioned in position adjacent the reservoir 20. Once the containers 14 are placed in the receptacles 12, if a door is provided, the door 62 can be closed upon the containers 14 by using a button, lever, paddle, or other mechanism.

FIG. 7B depicts opening the containers 14 so that they are punctured at a bottom end in order to allow fluid to exit the containers 14. If one container 14 is inserted at a time, then the steps of 7A and 7B would be repeated. If multiple containers 14 are inserted, they can be punctured at the same time and dispensed at the same time. The puncturing/opening mechanisms 40 can be coupled to the closing mechanism 44 in order to puncture the containers 14 when the door 62 or other mechanism is being closed. Once closed, the puncturing mechanism 40 punctures the containers 14. This can occur either automatically because of the movement of the door/doors 62 or electronically, with a puncturing mechanism 40 moving inwardly and outwardly.

Once the containers 14 are positioned inside the housing 56 and punctured, the containers 14 can be pressed or rolled in order to squeeze the contents from the containers 14. This can occur simultaneously with the door closing and puncturing steps of FIG. 7B, or can occur electronically by using a roller mechanism or other mechanism (not shown) to squeeze and press the contents from the container 14. FIG. 7C shows a squeezing zone 48 on the container 14. Since the reservoir 20 is closed by the valve 22 during the dispensing phase, it is not initially necessary to input water to the system. Once all the contents of the containers 12 are emptied into the reservoir 20, the valve 22 can be opened to release the materials from the reservoir 20 into an underlying cup 16. At the same time, water can enter the reservoir 20 from the water source W. A nozzle 42 can be used for directing the water at one or more locations within the reservoir 20. The water is metered out to mix with the contents of the containers 14 in a fixed amount in order to make the "perfect" drink. In addition, the water helps to clean the reservoir 20, since it may exit the reservoir 20 after the contents of the containers 14 have existed the reservoir 20.

When multiple containers 14 are positioned above the reservoir 20, ribs or barriers may be positioned inside the housing 56 in order to guide the containers 14 into respective slots. In addition, when multiple containers 14 are positioned in the receptacles 12, they can be easily removed by pulling them out at the same time from the top.

The valve 22 shown in FIGS. 7A-7D could be any type of known valve. Examples include flapper, ball, or stopper valve, among other valves. Preferably, the valve 22 does not disrupt the flow of fluid from the reservoir 20 upon opening. Other types of valves 22 that may be used are diaphragms. The valve 22 could be manual or electronic. When the valve 22 is electronic, a controller C, motor, and switch (not shown) can be used to control the valve 22 in a conventional manner, as known by those of skill in the art. An electromagnet (not shown) could be used to open the valve 22. A gear box (not shown) may be added if necessary for proper operation of the valve 22.

Figures 8A, 8B, 8C:
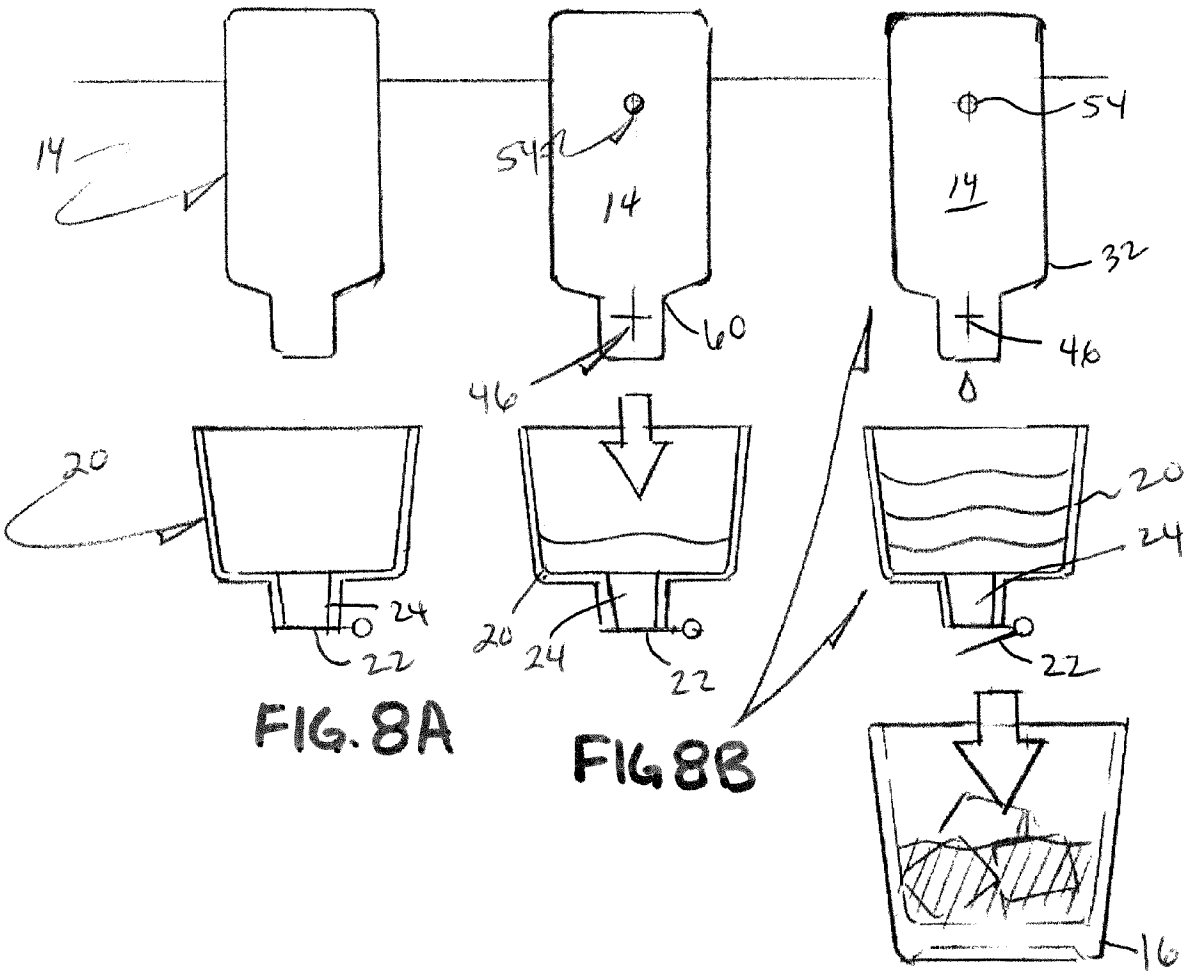
FIG. 8A depicts a schematic of dispensing according to FIGS. 2D and 2B, with one or more containers being positioned in the dispensing device.
FIG. 8B depicts a schematic of dispensing that occurs after FIG. 8A where the contents of the containers are deposited into a closed reservoir.
FIG. 8C depicts a schematic of dispensing that occurs after FIG. 8B where all the contents of the containers have been deposited into the closed reservoir and the valve to the reservoir being opened to dispense the ingredients into a cup.

FIGS. 8A-8C are similar to the device 10 shown in FIGS. 7A-7D, but instead of using a container 14 in the form of a bag, they utilize a thermoformed container 14 with a liner 52 on one side. They could alternatively use an injection molded container 14 with a liner 52 positioned at multiple different locations. FIG. 8A shows the container 14 in position over the reservoir 22. FIG. 8B shows the container 14 being dispensed into the reservoir 22. The container 14 is punctured at a lower end and a water nozzle 42 enters at the upper end in order to wash water through the container 14. In both of these steps, the valve 22 at the outlet of the reservoir is closed.

FIG. 8C shows how the ingredients in the container(s) 14 have been dispensed into the reservoir 20 and the valve 22 being opened in order to allow the ingredients and water to flow into a glass 16 that is positioned under the reservoir outlet 24. As discussed above in connection with FIGS. 7A-7D, an opening mechanism 40 may be used to puncture the container 14 and different types of valves 22 may be used, along with controllers and switches as needed. In addition, as discussed in FIGS. 5A-5C, a water inlet 54 is used to inject water into the container 14. Additional water may also be added to the reservoir 20 either before or after the valve 22 has opened in order to further dilute the contents of the reservoir 20 or to aid in washing the reservoir 20.

While not shown in FIGS. 8A-8C, it is contemplated that two or more containers 14 could be stacked in the housing 56 at one time and punctured simultaneously with a single opening mechanism 40 or with multiple opening mechanisms 40. Guides, rails or barriers may be used inside the housing 56 in order to allow proper placement of multiple containers 14. In addition, while the entrance for the water nozzle 42 is shown as being on the side of the container 14, it could be on the sides or top of the container 14, or on the bottom end of the container 14. If the water inlet 54 is on the bottom end of the container 14, the opening mechanism 40 (puncturing mechanism) and the water inlet 54 could be one-in-the same, as long as a punctured hole 46 that is made is larger than the water inlet 54 in order to allow ingredients and water to flow out of the container 14 around the inlet nozzle 54. As with prior embodiments, the containers 14 can be removed by pulling on an upper part of the containers 14 that sits above an upper surface of the housing 56. In addition, if desired, the reservoir 20 can be designed to be removable for occasional cleaning outside of the housing 56. The reservoir 20 could be replaced with a blender, mixer, or stirring chamber, if desired.

Figure 9C:
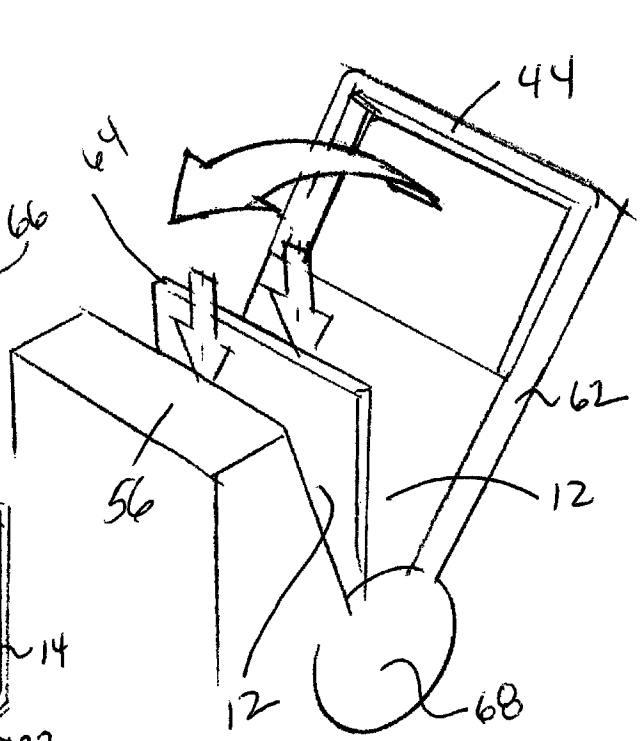
FIG. 9C depicts closing the receptacles in order to dispense the ingredients from the containers by squeezing.
Figure 9A:
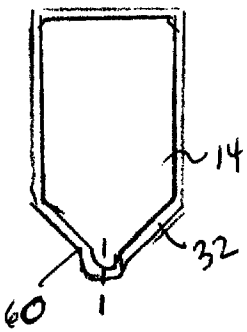
FIG. 9A depicts a container for insertion into the device shown in FIGS. 9B and 9C.
Figure 9B:
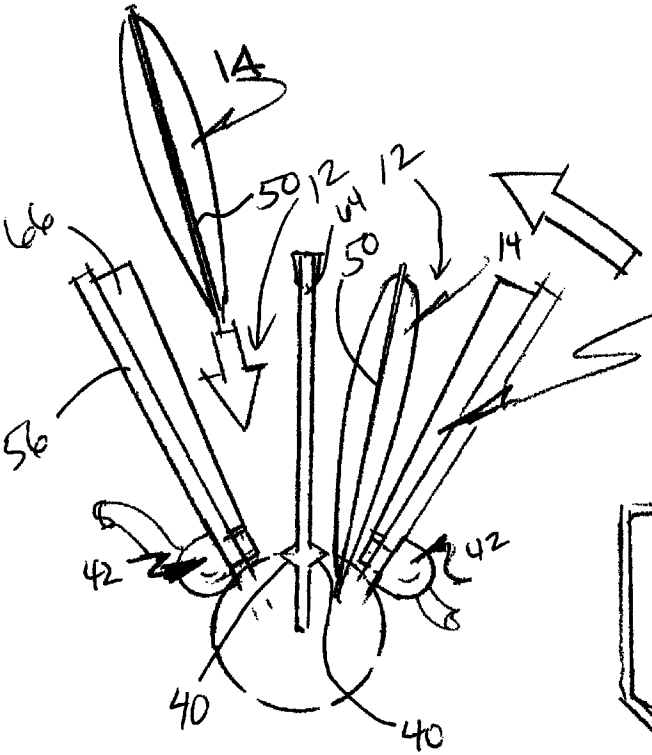
FIG. 9B depicts the container of FIG. 9A being deposited into receptacles in the dispensing device.

FIGS. 9A-9C depict one embodiment of the receptacles 12 for receiving the containers 14 in a back-to-back or stacked position. In this embodiment, pouches or bags 14 are utilized and positioned in receptacles 12 in the housing 56. This embodiment is similar to that shown in FIGS. 3A-3D and 7A-7D in that the containers 14 are squeezed in order to release the contents from the containers 14. In this embodiment, as shown best in FIG. 9B, a barrier 64 is positioned between the first receptacle 12 and the second receptacle 12 and the barrier 64 includes an opening mechanism 40 in the form of a piercing element extending from either side thereof for puncturing a lower end of the container 14.

The receptacle 12 has door panels 62 that are on either end of the receptacles 12 for closing down upon the containers 14. A closing mechanism 44 in the form of a lever, handle, or other mechanism can be used to close the containers 14 within the receptacles 12. The doors 62 have ramps or wedges 66 positioned on either side of the containers 14 in order to effectively squeeze the contents from the containers 14. The ramps 66 may be designed to apply greater pressure at a top end first so that the containers 14 are squeezed from the top down, if desired. Alternatively, the door panels 62 may evenly squeeze the containers 14. A water nozzle 42 is shown provided adjacent the lower end of the receptacle 12 in order to wash water over the end of the container 14 and piercing elements 40 and into the cup 16 that is positioned below.

A funnel 18 may be used to help direct the liquid from the containers 14 into a cup 16. If a funnel 18 is not used, a splash guard (not shown) may be used to help deter liquid from splashing out of the containers 14. The door panels 62 may include compressible ramps 66 that help to squeeze the containers 14. A linkage (not shown) may be provided at the pivot point 68 of the doors 62 to allow for different types of movement of the door panels 62. In addition, the pivot point 68 does not need to be a single pivot point. It could have offset pivot points. A linkage could be used to provide some linear movement of the doors 62 relative to one another. Examples of possible linkages include rack and pinion, cams, or other linkages. The linkages may be off to the side of the receptacles 12 or driven off a lever, among other techniques.

Figure 10C:
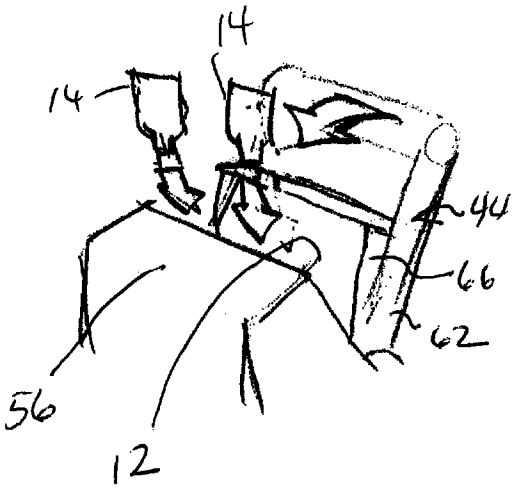
FIG. 10C depicts closing the receptacle in order to squeeze the contents from the containers.
Figure 10A:
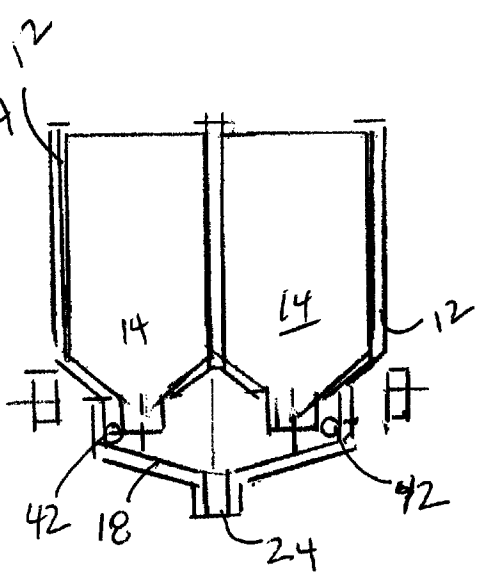
FIG. 10A depicts two containers positioned in two side-by-side receptacles of s dispensing device.
Figure 10B:
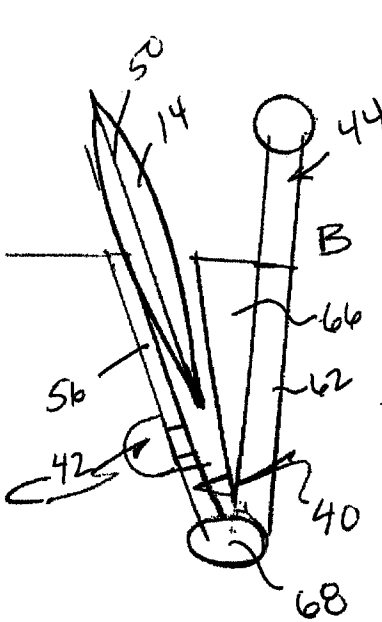
FIG. 10B depicts a side view of a container being positioned in a receptacle shown in FIG. 10A.

FIGS. 10A-10C are similar to the example shown in FIGS. 9A-9C, except for instead of stacking the containers 14, the containers 14 are positioned in side-by-side relation. The dispensing device 10 is similar to that shown in FIGS. 8A-9C in that it involves a door 62 that rotates inwardly to close the receptacles 12 and dispense fluid from the containers 14 by squeezing or pressing on them. The piercing mechanism 40 is shown built directly into a barrier 64 that is provided inside the receptacles 12, so the containers 14 need to be positioned low enough in the receptacle 12 for the piercer to work to open the containers 14. Ridges and barriers may be provided under, over, and between the containers 14 in the receptacle 12.

A water inlet 54 is shown provided in the vicinity of the piercing member 40 on each side of the receptacle 12 to assist in washing fluid from the containers 14 down into the underlying funnel 18. The funnel 18 has an outlet 24 for dropping the fluid by gravity into a cup 16. The water inlet 54 may be positioned at other locations, such as to the side of the piercer 40 or on top of the piercer, if desired. The water inlets 54 help to wash the funnel 18 after all the liquid has been pressed out of the containers 14. The water could be cycled in sequence through the water inlet 54 so that the water inlets 54 open after the containers 14 have been pressed to release the fluid inside the containers 14.

FIG. 10B shows how one of the walls in the receptacle 12 has a ramped portion 66 that assists in squeezing the contents from the container 14. The ramp 66 can be designed to provide pressure first to one end over the other, or to provide uniform pressure. The door panel 62 of the device 10 is shown as being rotatable inwardly to close the receptacles 12 about a pivot point 68. The door panel 62 could be designed with offset pivots so that part of the motion of the door panel is linear in order to promote even squeezing of the container 14 or squeezing from the top down. The door panel 62 may be closed by pulling the door panel 62 forward. A detent (not shown) or resilient member (not shown) could assist in keeping the door panel 62 closed during squeezing and could be released by pulling back on the handle 44. Other types of closing mechanisms 44 could be used, including other mechanical locking mechanisms and electronic locks, if desired. Upon opening of the receptacles 12 after dispensing, the containers 14 could be ejected with an ejecting arm (not shown) in order to allow the user to easily remove the containers 14.

While not shown, four pouches could be utilized instead of two, with two pouches being stacked on top of each other in each receptacle 12. The puncturing mechanism 40 would need to be long enough and sturdy enough to puncture both containers 14 on each side.

Figure 11B:
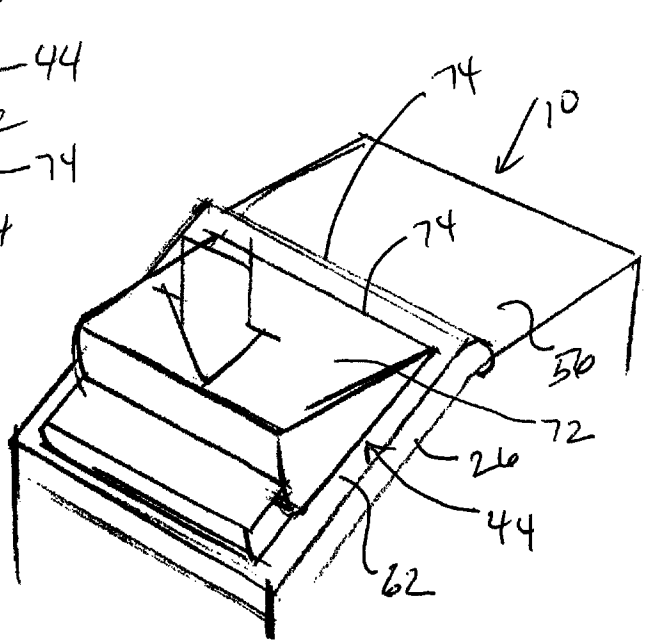
FIG. 11B depicts closing a door on the receptacle in order to squeeze the ingredients from the containers.
Figure 11A:
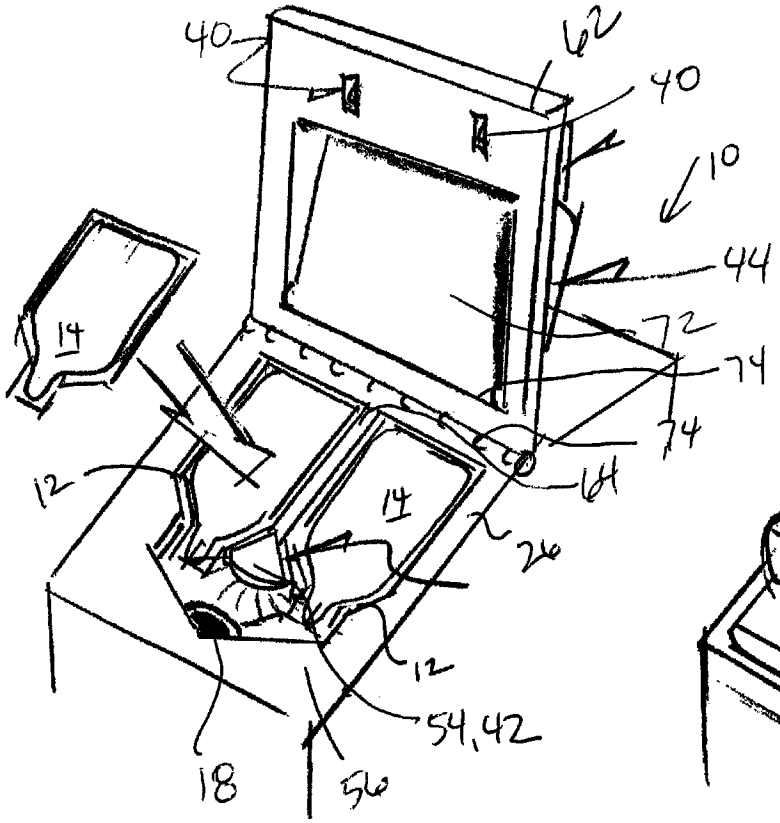
FIG. 11A depicts an alternative embodiment where the containers are positioned in receptacles on a top surface of the device.

FIGS. 11A-11B depict an alternative embodiment similar to that shown in FIGS. 10A-10C, but with an upwardly facing receptacle 12 that has a door 62 that closes down on top of the receptacle 12. Receptacles 12 are formed on an upper surface 70 of the housing 56 and may include ribs, ridges, and/or barriers to hold the containers 14 in side-by-side relation in the receptacles 12. The user positions the containers 14 in the receptacles 12 neck down. The receptacle 12 has a built in funnel 18 positioned below the lower ends of the containers 14 in order to direct the contents of the containers 14 into an opening 24 provided at the bottom of the funnel 18. The liquid from the containers 14 travels through this opening 24 into a glass 16 that is positioned below the opening 24. A water sprayer 42 is provided between the two receptacles 12 in order to add water to the mixture and to clean the funnel 18 and lower ends of the containers 14, as well as the opening mechanisms/piercers 40.

Piercers 40 are positioned on a door 62 that closes the receptacles 12. The piercers 40 may be retractable, if desired. If retractable, the piercers 40 could be associated with a spring-loaded panel that can be pressed downwardly in order to pierce the containers 14 in the receptacles 12 and retract upon release of the panel (not shown). When the door 62 is closed, the piercers 40 engage the containers 14 to open the containers 14 at a bottom end thereof. Then the user can press a rotatable cover 72 downwardly in order to squeeze the liquid from the containers 14. A lower surface of the cover 72 acts upon the containers 14 when the cover is pressed since the cover rotates over the containers 14. The water sprayer 42 can be activated while the cover 72 is being pressed down, or after the cover 72 is released. The cover 72 can be spring loaded so that the user presses against the force of the spring and then the cover 72 returns to a non-engaged position upon release by the user. The piercers 40 may be coupled to the cover 72, as well, so that a separate piercing panel is not needed. Alternatively, the piercers 40 could be non-retractable. A hinge 74 is provided at the top of the door panel 62 and at the top of the cover 72 in order to allow for pressure to be applied to the pouches from the top down. After a drink has been dispensed, the user opens the door panel 62 and removes the emptied containers 14 by hand.

Figures 12A, 12B, 12C:
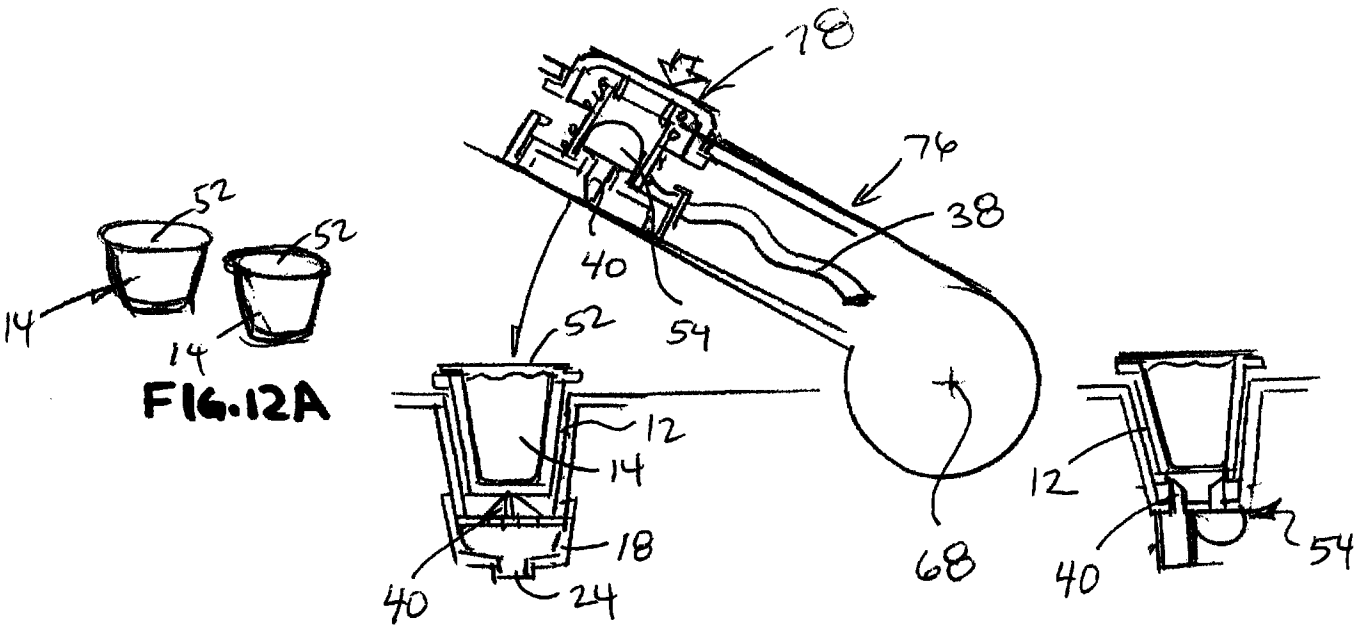
FIG. 12A depicts an alternative shape for a container that is thermoformed and sealed with a foil seal.
FIG. 12B depicts an alternative embodiment where the container of FIG. 12A is positioned vertically in a receptacle and an arm rotates downwardly over the container in order to open the container.

FIGS. 12A-12C depict another alternative embodiment where the container 14 is shaped more like a cup. The cup is thermoformed with a liner 52 on top, such as a foil liner. While a single container 14 is shown, multiple side-by-side containers 14 could be used. The containers 14 are placed in a receptacle 12 so that the liner 52 is positioned upwardly. An arm 76 swings downwardly upon a pivot point 68 so that a piercing element 40 at the end of the arm 76 pierces the liner 52 on the container 14. Force provided by the arm 76 may also pierce the bottom of the container 14 in order to allow fluid to flow from the container 14 by gravity. Alternatively, the user may be required to press downwardly on the arm 76 in order to pierce the bottom of the container 14. Water may be input into the top opening of the container 14, as shown in FIG. 12B, or into a bottom opening of the container 14, as shown in FIG. 12C. If water is input at the bottom, the top piercing is not needed.

Figure 18A:
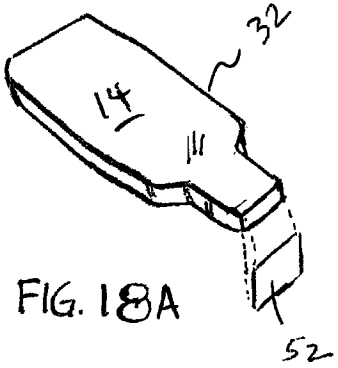
FIG. 18A depicts another alternative container that is bottle shaped and has an opening at the top end of the bottle that is sealed with a foil liner.
Figure 18B:
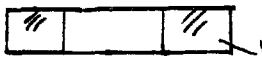
FIG. 18B depicts the container of FIG. 18A in an end view, showing the opening in the top end of the bottle.
Figure 18C:
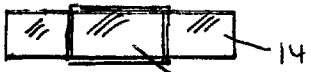
FIG. 18C depicts the container of FIG. 18A with a foil seal sealed over the opening in the bottle.

The arm 76 may be spring loaded so that it can be easily moved upwardly. In addition, the arm may have a spring loaded portion 78 near the head end of the arm 76 that allows the user to close the arm 76 and then press downwardly against action of the spring in order to pierce the top and/or bottom of the container 14. Water and liquid from the container 14 exit the container 14 below the container 14 though drain created by the pierced hole in the container 14. While a cup-shaped container 14 is shown being used in this embodiment, other shapes of containers 14, including bags, could be used in this embodiment. As shown in FIGS. 18A-18C, a bottle-shaped container 14 could be used that has an opening at the end of the bottle only.

Figures 13A, 13B, 14A, 14B, 14C:
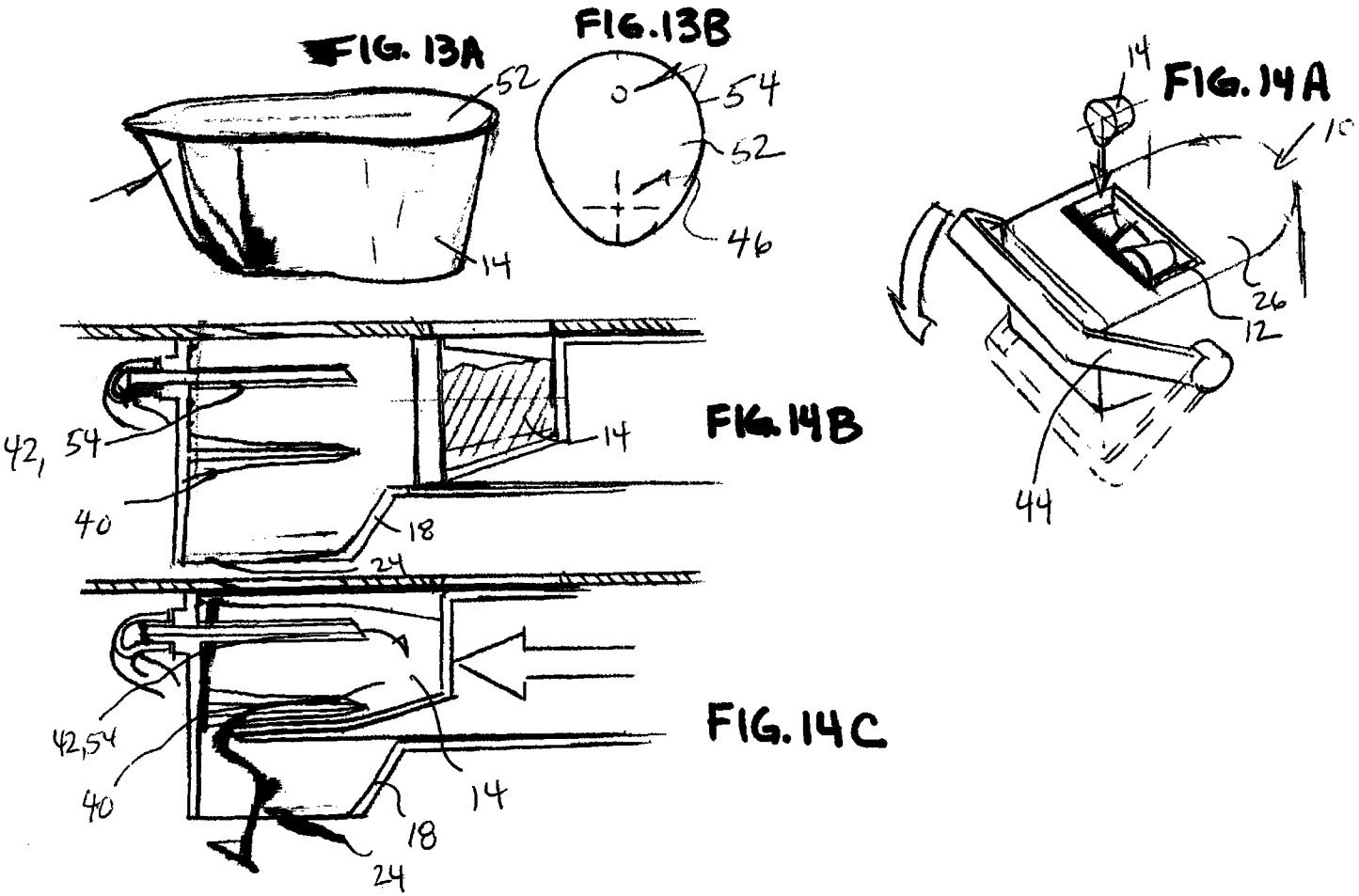
FIG. 13A depicts an alternative shape for a container.
FIG. 13B depicts a top view of the container of FIG. 13A.
FIG. 14A depicts yet another alternative embodiment where a dispenser includes receptacles positioned on a top wall of the dispenser, and a pull lever is used to open the containers for dispensing.
FIG. 14B depicts how a container moves horizontally toward a water source and a piercing element.
FIG. 14C depicts the container engaged with the piercing element and an inlet nozzle for water and dispensing of the ingredients and water though an opening in the bottom of the housing member.

FIGS. 13A and 13B depict another shape for a container 14 that has as spout and is generally egg shaped when viewed from a top end. The container 14 may be formed by thermoforming the bottom reservoir of the container 14 and closing the container 14 with a film or liner, such as a foil film. The top surface of the containers 14 may be used for both a water nozzle inlet 54 and for a drain port 46. The water spout inlet 54 and drain port 46 could be at different locations, if desired. The container 14 of FIGS. 13A and 13B is depicted in one possible usage in FIGS. 14A-14C.

FIGS. 14A-14C depict an embodiment where the housing 56 has an opening on a top surface 70 of the device 10 and the containers 14 are inserted into the receptacles 12 so that the film side 52 of the containers 14 faces the front of the device 10. A lever or handle 44 is pulled downwardly, which results in the linear movement of the containers 14 such that they move forwardly. FIG. 14B shows a side cross-sectional view of the container 14 in a receptacle 12 before the handle 44 is moved downwardly and FIG. 14C shows a side cross-sectional view of the container 14 when it has been moved forwardly by movement of the handle 44. When the container 14 is moved forwardly, it engages an opening mechanism 40 and a water inlet 54 that are positioned on a wall at the end of the chamber. Water enters the container 14 through the water inlet 54 and the contents of the container 14 and the water exit the container 14 through the drain hole 46, and are then deposited into a cup 16. A funnel 18 may be used, if needed, to direct the contents into a cup 16. The handle 44 may be spring loaded so that after it is released, the containers 14 travel rearwardly in order to allow a user to remove them from the receptacle 12. This example could also be utilized with other shaped containers 14.

Figure 15A:
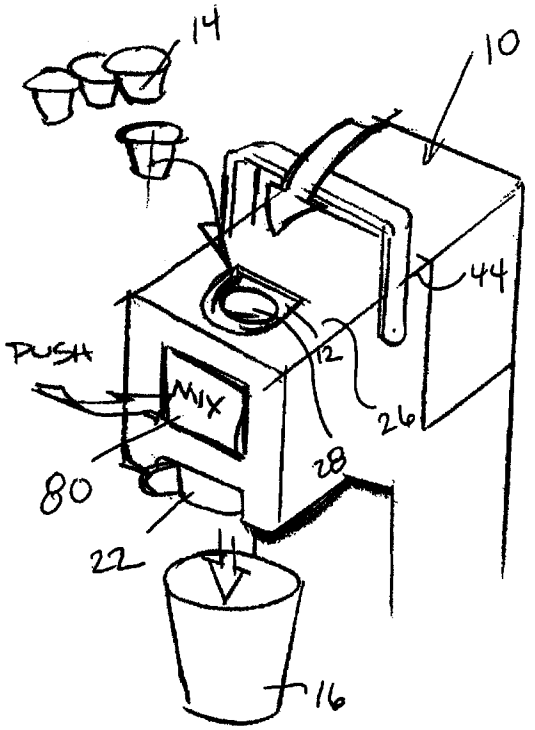
FIG. 15A depicts another alternative embodiment where one or more containers are positioned in a receptacle and the ingredients are mixed in a mixing chamber before being dispensed into a glass.
Figure 15B:
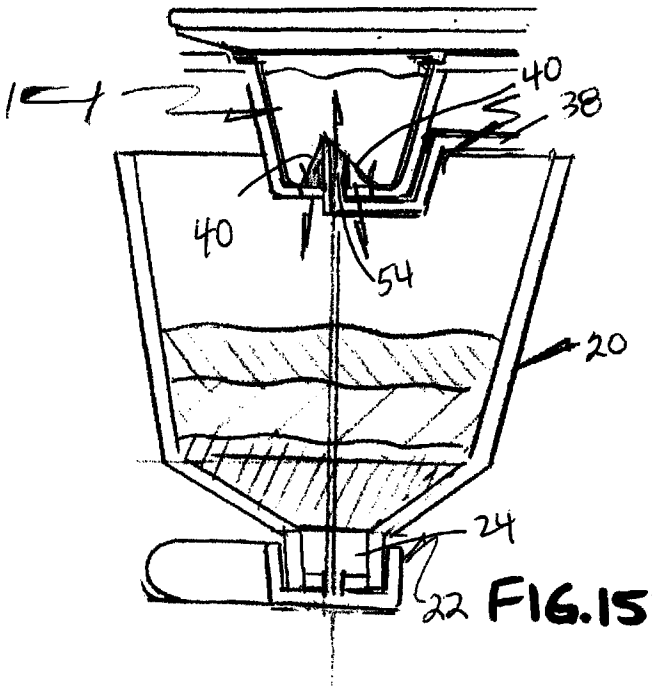
FIG. 15B is a cross-sectional view of the mixing chamber of FIG. 15A, showing how water is introduced below the container at the same time that the container is pierced.

FIGS. 15A and 15B depict yet another embodiment of the dispenser 10. In this example, a receptacle 12 is shown being positioned on an upwardly facing surface 70 of the dispenser 10. The receptacle 12 could be positioned at other positions, such as on the sides, as well. FIG. 15A shows only one receptacle 12, but it is anticipated that more than one receptacle 12 would be utilized. In this example, the container 14 is positioned in the receptacle 12 and a handle 44 is pulled forwardly. This causes the handle 44 or another door 62 to cover the container 14 in the receptacle 12 and to press it downwardly until it engages an opening mechanism 40, such as a piercer, and a water spout 54, but of which engage the container 14 on a lower surface of the container 14. After the handle 44 is positioned forwardly, the users presses a "MIX" button 80 on the front of the device 10, which activates the flow of water into the container 14. Liquid from the container 14 mixes with water inside the reservoir 20 that is formed under the container 14. The reservoir 20 is closed with a valve 22, which is shown to be a manual valve, but could be a non-manual valve that is activated to open when the user lets go of the mix button, or after a certain amount of time has passes, among other times. The reservoir 20 could alternatively be a blender or mixer and the user could operate the blender or mixer by pushing the MIX button. The MIX button is preferably tied to a motor or solenoid (not shown) in order to open the water flow into the mixing reservoir 20. Upon movement of the handle 44 back to its original position, the container(s) 14 can be removed from the receptacle 12.

Figure 16A:
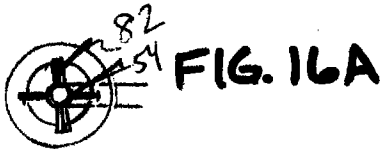
FIG. 16A depicts an example opening mechanism for opening the containers.
Figure 16B:
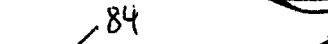
FIG. 16B depicts another example opening mechanism design for opening the containers in the form of a straight blade or exacto knife blade.
Figure 16C:
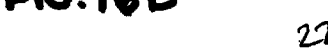
FIG. 16C depicts another example opening mechanism in the form of a piercing awl.
Figure 16D:
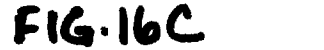
FIG. 16D depicts yet another example opening mechanism in the form of a V-shaped cutting element.

FIGS. 16A-16D depict various different types of opening mechanisms 40. FIG. 16A depicts a cruciform blade 82 and also shows how a water inlet 54 can be positioned to eject fluid through a center of the cruciform blade 82. FIG. 16B depicts a straight blade or an exacto knife blade 84. FIG. 16C depicts a pointed awl 86 and FIG. 16D depicts a V-blade 88, which can be formed by bending a piece of steel into a V-shape and sharpening it. Any of these opening mechanisms 40 may be used. They may be made of steel, another metal, or, in some cases, hard plastic.

Figure 17:
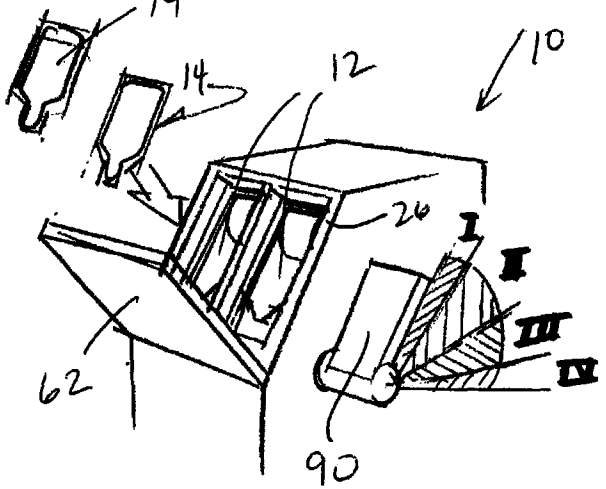
FIG. 17 depicts another alternative embodiment where the containers are position into a receptacle formed on an inclined surface of the dispensing device and a lever is used to dispense the ingredients from the containers.

FIG. 17 depicts another embodiment where receptacles 12 are positioned on an upwardly facing 70 or side facing surface of the dispenser 10. A door 62 closes the receptacle 12 and is hinged by a hinge 74 at a lower end of the door 62. Alternatively, the door 62 could be hinged at an upper end. The dispenser 10 has a lever 90 positioned on a side of the device 10. The lever 90 may be used to open and close the door 62, or the user can manually open and close the door 62.

After the containers 14 are positioned in the receptacles 12, the user closes the door 62. Then the lever 90 may be pressed downwardly to activate the device 10. A first movement of the lever I may close the door 62. A second movement II of the lever 90 presses the door 62 downwardly to cut the container 14. A third further movement III of the lever 90 causes the door 62 to press down on the container 14 to squeeze the contents from the container 14. A fourth further movement IV activates the water flow in order to clean the receptacles 12 and any funnel 18 that is positioned beneath the receptacles 12. A controller can be used to control the amount of water that is dispensed by the pump P so that enough water is mixed with the container ingredients. Thus, even if the user releases the lever before the water has fully flowed into the cup 16, the water will continue to fill the cup 16 to provide the "perfect" cocktail. Instead of a squeezing motion provided by the door 62, a rolling motion could be provided by rollers (not shown) that engage the container 14 when the lever 90 is pressed downwardly, but retract when the lever 90 is released.

FIGS. 18A-18C depict an alternative container 14 that is formed by injection molding so that only a small portion of the container 14 needs to be covered by a liner or foil 52. In the embodiment shown, the top of the bottle-shape is the only open surface of the container 14. Alternatively, even a smaller surface could be left open and the material could be formed so that it is thin enough to be easily opened by piercing. Any type of material may be used that is acceptable for food, including ABS, Acetal, K Resin, Nylon, PET, Polypropylene, Polyethylene, Styrene, TPE or other materials. The liner 52 can be a foil liner that is sealed to the opening in the container 14. Other types of covers or liners 52 could be used to close the opening in the container 14.

Figure 19:
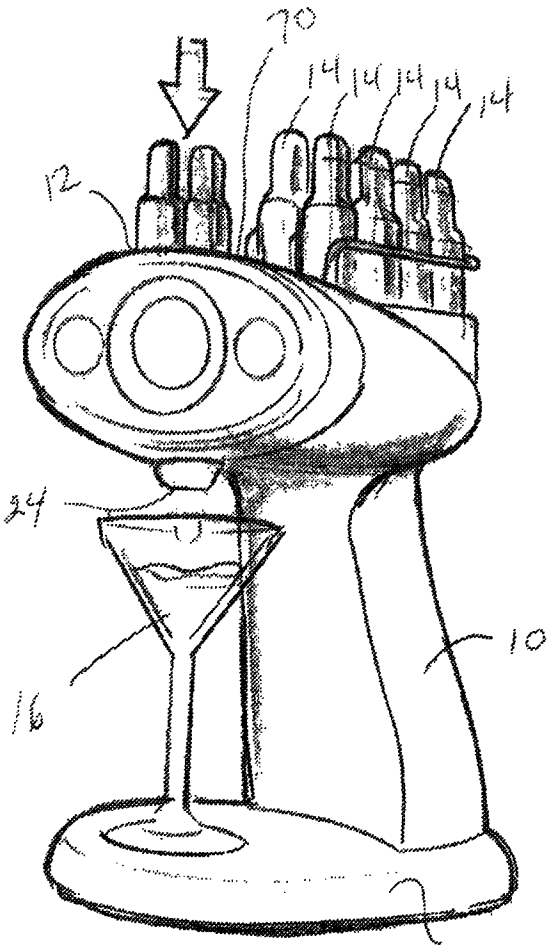
FIG. 19 depicts a perspective view of an alternative dispensing device design.
Figure 21:
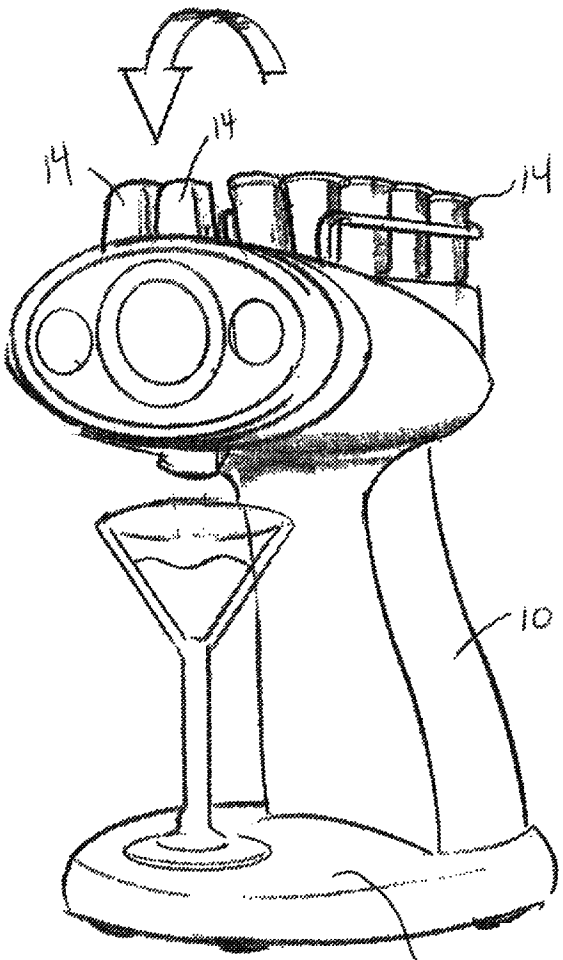
FIG. 21 depicts a perspective view of an alternative dispensing device design.
Figure 23:
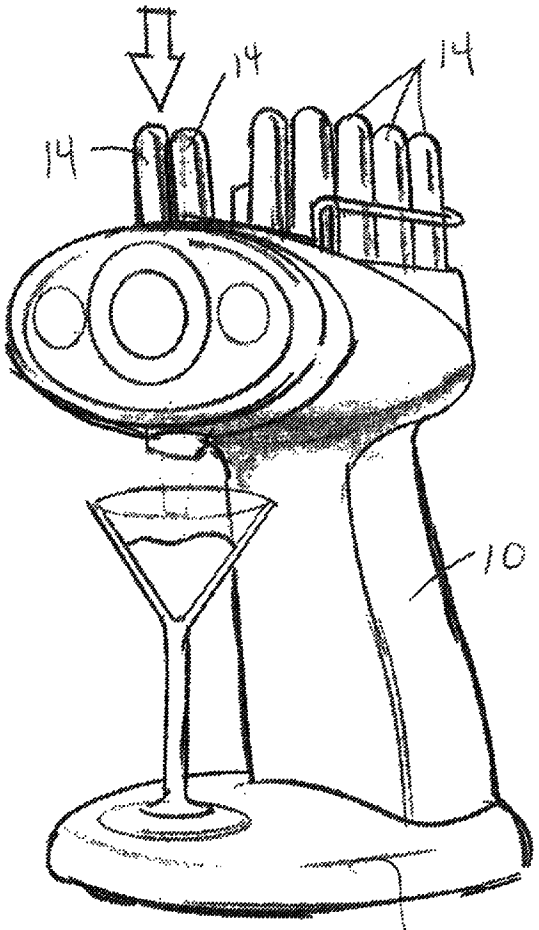
FIG. 23 depicts a perspective view of an alternative dispensing device design.

FIGS. 19, 21, and 23 depict an alternative dispensing device 10 where the receptacles 12 are positioned on an upper surface of the housing and additional containers 14 are stored on top of the dispensing device. FIGS. 19, 21, and 23 depict a cup/glass 16 positioned under the outlet 24 of the device 10.

Figure 20B:
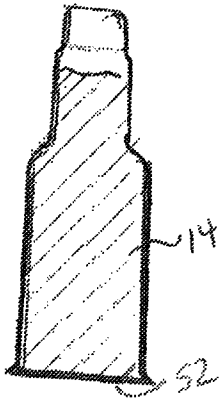
FIG. 20B depicts a cross-sectional view of the alternative container design of FIG. 20A.
Figure 20A:
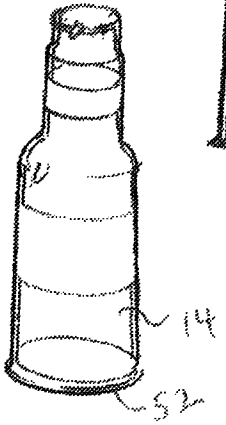
FIG. 20A depicts a perspective view of an alternative container design.

FIGS. 20A and 20B depict an alternative design for the container 14 in the form of a bottle. This container 14 can be formed by injection molding and has a seal 52 across a bottom surface. A rim 102 is also formed around the bottom of the bottle for seating of the seal thereon. The seal 52 can be any type of known seal for closing a container, such as a foil seal, among other seals, as long as it is strong enough to withstand normal shipping.

Figure 22B:
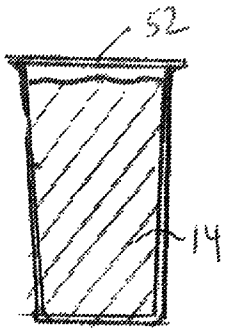
FIG. 22B depicts a cross-sectional view of the alternative container design of FIG. 22A.
Figure 22A:
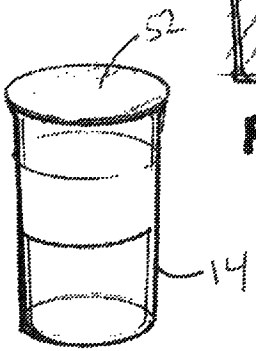
FIG. 22A depicts a perspective view of an alternative container design.

FIGS. 22A-22B depict an alternative container 14 design in the shape of a cup. The container 14 can be formed by injection molding and has a seal 52 across a top surface of the cup. A rim 102 is also formed around the top of the cup for seating the seal thereon. The seal 52 can be any type of known seal for closing a container, such as a foil seal, among other seals, as long as it is strong enough to withstand normal shipping. This design would easily permit the consumer to drink the contents of the container 14 straight up without mixing with a mixer.

Figure 24B:
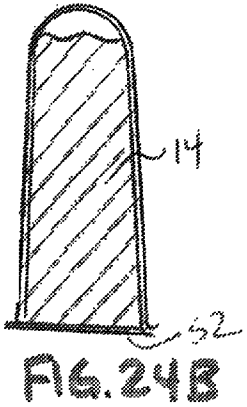
FIG. 24B depicts a cross-sectional view of the alternative container design of FIG. 24A.
Figure 24A:
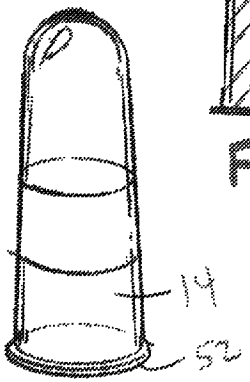
FIG. 24A depicts a perspective view of an alternative container design.

FIGS. 24A-24B depict an alternative container 14 design in the shape of a test tube. The container 14 can be formed by injection molding and has a seal across a bottom surface of the cup. A rim 102 is also formed around the bottom of the test tube for seating the seal thereon. The seal 52 can be any type of known seal for closing a container, such as a foil seal, among other seals, as long as it is strong enough to withstand normal shipping. This design could serve a dual purpose of use in the dispensing device 10 and use as a jello shot.

Figure 25:
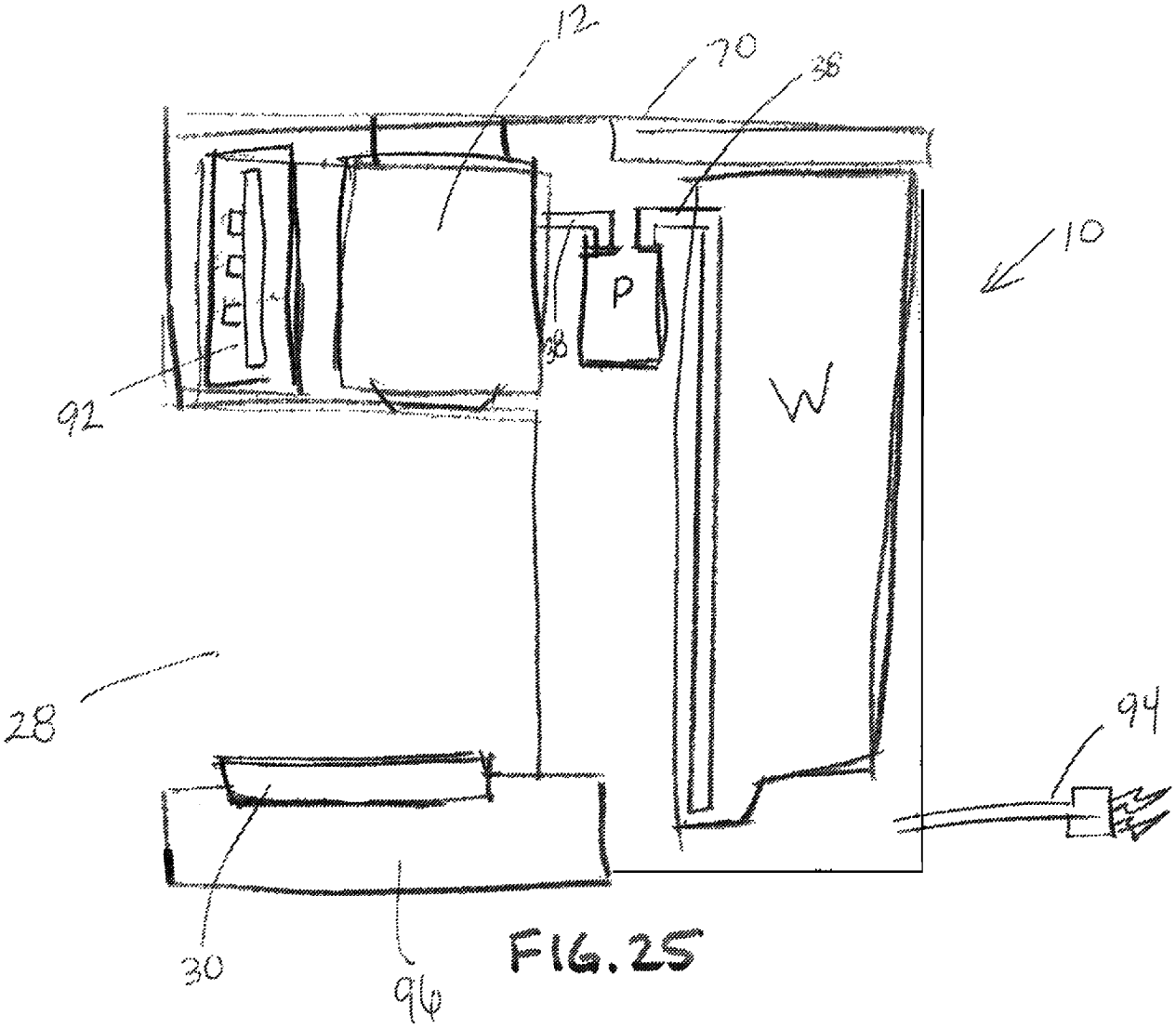
FIG. 25 depicts a schematic of the inner workings of one embodiment of the dispensing device.

FIG. 25 depicts a schematic layout of an interior of a dispensing device 10. The dispensing device 10 includes a water tank W, a base 96 and a power cord 94. The base 96 holds a drip tray 30. A top part of the device 10 includes a pump P coupled to the water reservoir W by fluid lines 38. The fluid lines 38 lead into the receptacle section 12 of the device and an outlet 24 is included for dispensing from the containers 14 when inserted into the receptacles. A control panel 92 is also shown as including several buttons on a front panel of the housing 56. The water reservoir may hold 32 ounces of water, among other amounts. The water reservoir could be removable so water can be chilled in advance. Other types of liquids may be held in the water reservoir, if desired, like ginger beer, for example. The power cord 94 provides power to the pump P.

FIG. 26 depicts an alternative opening mechanism 40 in the form of a triple blade cutter, with the blades disposed around and extending outwardly from a water inlet 54. The fluid line 38 leads to the water inlet 54.

FIGS. 27A and 27B depict an alternative mechanism for dispensing the contents on the containers and could be used with any of the containers shown in FIGS. 20A & 20B, 22A & 22B, and 24A & 24B. In this embodiment, the container 14 is positioned in a receptacle so that the seal is facing downwardly. For the embodiment shown in FIG. 19, the container would be removed from the storage area on the top of the dispenser and positioned in the receptable so that the bottom of the bottle faces down. For the embodiment shown in FIG. 21, the container would be removed from the storage area on top of the dispenser and rotated so that the top of the cup faces downwardly. For the embodiment shown in FIG. 23, the container would be removed from the storage area on top of the dispenser 10 and positioned in the receptacle so that the seal is positioned downwardly.

FIGS. 27A and 27B depict the container 14 positioned in dual receptacles 12 that are positioned on top of the housing 56 of the dispenser 10. In this embodiment, it is not necessary to cover the top end of the containers 14 in order to activate the containers 14 to release their contents. Instead, the containers 14 are first positioned in the receptacles 12. A flange or arms 98 surround the sealed area 52 of each container 14 inside the receptacles 12. The user presses downwardly so that the arms 98 move downwardly. As the arms 98 move downwardly, they move against a camming surface that is defined on the arms 98 and on the inner wall 100 of the receptacle such that they move inwardly and trap the rim 102 of the container 14 below the arms 98. The arms 98 help to hold the container 14 in proper position for dispensing. As the container 14 moves downwardly, it is forced into engagement with an opening mechanism 40, which is shown as being a piercer. In addition, a water inlet 54 is positioned directly adjacent the piercer 40 for allowing the input of water into the container 14. The opening mechanism 40 causes the seal 52 to be broken and allows the contents of each container 14 to be evacuated from the container 14 and to flow downwardly into the funnel 18 and out the opening 24.

While not shown, another type of mechanism for dispensing may include a rotary or linear movement of a container 14 in a housing 56. In this example, a cover could be used to activate the movement of the rotary or linear movement of the containers 14. The containers 14 could be positioned in their respective receptacles 12, the cover could be closed and pressed downwardly to activate the device 10. Alternatively, a separate button could be pressed to activate the device 10. The cover helps to press the container 14 downwardly, which punctures the bottom of the cup 16 while the top is punctured with a water inlet 54. The contents of the container 14 are drained and water is added, which rinses the container 14. The containers 14 could be indexed so that one container 14 dispenses at a time, even though multiple containers 14 are loaded into the receptacles 12.

As previously discussed, where one or two containers 14 are shown, more than one or two containers 14 maybe utilized.

The opening mechanisms 40 may be piercing, cutting or slicing members, or other known members for opening a container 14. The opening mechanisms 40 are selected as a function of the type of containers 14 used to hold the ingredients. If one or more opening members are used, they each may be the same or different from one another.

The device 10 may be a counter-top machine that allows 2, 3, 4 or more liquids/slurries to mix together in specific ratios (minimizing liquid components to keep carbon footprint of the mixed drink at a minimum). A water source W may be a water reservoir W that is refillable and part of the device 10. A tank of any size, such as 32 ounces, may be utilized as the water reservoir W. Alternatively, the device 10 could be connected to a water line so that the water reservoir is not needed.

The container sizes and shapes may vary from that shown here and relative to one another in use. One possible size for a large pouch is a capacity of 6-8 oz. Another pouch or container may have a size of 1-2 ounces. The pouches or containers may hold concentrated ingredients. As such, the size of the pouches or containers may be reduced. For example, a 2 ounce pouch of orange juice concentrate may make 8 ounces of juice when properly re-constituted. Examples of types of components that may be used in making a cocktail using the device 10 include the following, which represent different viscosities: Syrup, Alcohol, Juice/Juice Puree, Dairy, a combination thereof, or other components not mentioned.

The dispensing device 10 is compact and stylized. The dispensing device 10 is easily cleaned/maintained. A separate container may be added to the first and second containers 14 to provide a carbonating component. Alternatively, a separate carbonation system may be utilized along with flavoring and alcohol containers 14. A $CO_2$ container may be used for purposes of carbonation, if desired.

The dispenser 10 may be used to make any number of different types of cocktails. Examples of types of cocktails include those presented at http://www.drinksmixer.com/cat/1/ (12000+ cocktail recipes). As an example, one type of cocktail that may be made with the device 10 is "Sex on the Beach," a popular fruit mixed drink made of vodka, peach schnapps, creme de cassis, and orange and cranberry juices. An individual container 14 for "Sex on the Beach" may be input to the system as well as a "shot" container 14 that includes a combination of vodka, peach schnapps and créme de cassis. Alternatively, the "Sex on the Beach" container 14 may already include all the components with the exception of vodka, which may be input using a separate shot container 14. Alternatively, separate receptacles 12 for receiving multiple components may be used, or containers 14 may be sized to seat on top of or stacked against each other, with the opening or piercing member piercing through all containers 14 in the receptacle 12 in order to permit water to flow through each of the containers 14, or for the containers 14 to drain via gravity, in order to permit multiple different types of alcohol to flow from a single or multiple receptacles 12. For example, a single receptacle 12 could house the "Sex on the Beach" non-alcoholic components while a second single receptacle 12 could house the alcohol components including a peach schnapps container 14, a créme de cassis container 14, and a vodka container 14. The alcohol components could be stacked on top of each other or otherwise arranged in the receptacle 12. The alcohol components could be the same size or different sizes, depending upon what is called for in the drink recipe.

Another type of cocktail that is well known is the "Gin Fizz". A Gin Fizz uses gin, lemon juice, soda water, and gomme syrup. In this example, one receptacle 12 would receive a container 14 of Gin and the other receptacle 12 would receive a mixer container 14 that contains lemon juice and gomme syrup. A separate input can provide the soda water—either added external to the device 10, such as by pouring soda water into the removable cup 16, or via a separate carbonation unit that permits the dispensation of carbonated soda water to the system. Where a separate carbonation system is used, the water may flow from the reservoir into the carbonation system where it is carbonated. Then, carbonated water may either flow through the pouches or containers 14, or flow separately to the cup 16. In one example, uncarbonated water travels through the pouches and containers 14 to dispense them into the cup 16, while soda water travels separately to the cup 16.

Ice dispensing may be provided by an auxiliary device (not shown) that is either integral with or separate from the device 10. The device 10 may include a refrigeration component (not shown) in order to chill or cool the components rapidly during the dispensing process. The device 10 may include a sensory signal to indicate that the products are being mixed together during dispensation.

The device 10 may include smart technology, such as an RFID chip reader and a processor and/or controller C for directing the operation of the device 10. The containers 14 may include a chip, such as an RFID chip that includes instructions for the device 10 to make the cocktail properly. For example, the chip may include instructions for how much water to add to the contents of the pouch, whether to use plain water or carbonated water, or a combination of both, how much pressure to apply to the contents of the container 14, or other instructions that aid in properly preparing a cocktail. A chip reader reads the instructions from the chip when the container 14 is placed into the receptacle 12. These instructions are then communicated to the processor, which then instructs the various parts of the device 10 to operate according to the instructions. The device 10 may include a processor and/or controller C regardless of whether RFID technology is used in order to allow for proper operation of the device 10. Other ways, other than RFID technology, may be used in order to send instructions from the pouch to the processor, as known by those of skill in the art.

Other types of containers 14 or shapes of containers 14 may be used, including those having different openings. Different surfaces of the containers 14 may be pierceable. It may be desirable to have the container 14 opened from two ends, including an upper end and a lower end in order to permit the flow of water through the container. Alternatively, a single opening could be used.

Various parts of the device 10 can be transparent, including the containers 14, if desired. Advertising material and instructions may be positioned on the containers 14 and on the devices 10.

The term "substantially," if used herein, is a term of estimation.

While various features of the claimed invention are presented above, it should be understood that the features may be used singly or in any combination thereof. Therefore, the claimed invention is not to be limited to only the specific embodiments depicted herein.

Further, it should be understood that variations and modifications may occur to those skilled in the art to which the claimed invention pertains. The embodiments described herein are exemplary of the claimed invention. The disclosure may enable those skilled in the art to make and use embodiments having alternative elements that likewise correspond to the elements of the invention recited in the claims. The intended scope of the invention may thus include other embodiments that do not differ or that insubstantially differ from the literal language of the claims. The scope of the present invention is accordingly defined as set forth in the appended claims.

What is claimed is:

1. An apparatus for making a mixed drink comprising:

a housing having at least a first receptacle and a second receptacle;

a first single-serve beverage container for seating in the first receptacle;

a second single-serve beverage container containing a liquid alcohol product for seating in the second receptacle;

an opening mechanism having a blade for slicing open the first and the second single-serve beverage containers to allow the contents thereof to be at least in part evacuated, with the opening mechanism being movable towards and into the first and second beverage containers;

a chamber having at least one inlet for receiving the contents from the first and second single-serve beverage containers to allow the contents to mingle, said chamber further including an outlet;

a water reservoir coupled to the housing; and a pump coupled to the water reservoir for transferring water from the water reservoir to the vicinity of the first and second receptacles such that water from the water reservoir enters the chamber, with at least one of:

water entering the chamber directly; and water entering one or both of the first and second containers.

2. The apparatus of claim 1, further comprising a third receptacle in the housing for holding a third single-serve beverage container, with the third container, said third receptacle in communication with the first and second receptacles to permit mingling of the contents of the third container with the contents of the first and second containers.

3. The apparatus of claim 1, further comprising a closing mechanism for acting upon the first and second containers within the housing such that the opening mechanism is activated to open the containers when the closing mechanism is closed.

4. The apparatus of claim 3, further comprising a cover or door associated with the receptacles for closing the receptacles utilizing the closing mechanism, wherein the door or part of the door or cover is one or more of stationary or rotatable about a hinge to the closed position.

5. The apparatus of claim 1, wherein the containers are opened by the opening mechanism substantially simultaneously.

6. The apparatus of claim 1, wherein contents of the containers are evacuated by gravity, by squeezing, by flushing, or by a combination thereof.

7. The apparatus of claim 1, further comprising a control system for operating the apparatus to dispense a beverage from the outlet of the chamber and a control panel for entering instructions to the control system.

8. The apparatus of claim 1, wherein the first and second containers are formed by thermoforming and closed with a seal, formed by injection molding and closed with a seal, or formed as a sliceable or cuttable bag or pouch.

9. The apparatus of claim 1, wherein the container is substantially bottle-shaped in at least one dimension, or the container is test tube shaped, cup shaped, or hour-glass shaped.

10. The apparatus of claim 1, wherein the first and second beverage containers are stacked back-to-back and the opening mechanism slices open both the first and second beverage containers at the same time.

11. The apparatus of claim 1, wherein the opening mechanism moves inwardly towards the first and second beverage containers to slice open the containers and outwardly away from the first and second beverage containers.

12. The apparatus of claim 1, wherein the housing includes a guide, rail, rib or a barrier that separates the first and second beverage containers.

13. The apparatus of claim 1, wherein the first and second beverage containers are stacked in the housing and opened simultaneously with a single opening mechanism.

14. An apparatus for making a mixed drink comprising:

a housing having at least a first receptacle, a second receptacle, and an outlet, said first receptacle for receiving a first single-serve container holding a first contents and said second receptacle for receiving a second single-serve container holding a second contents, said first and second receptacles coupled to the outlet;

a first opening mechanism that is movable for slicing or cutting the first single-serve container open with a blade to permit the release of the first contents from the first container;

a second opening mechanism that is movable for slicing or cutting the second single-serve container open to permit the release of the second contents from the second container;

a water source coupled to the housing; and a pump positioned in the housing coupled between the water source and the outlet of the housing for pumping water through the housing to exit through the outlet;

wherein the first contents of the first container are at least in part evacuated therefrom upon activation of the first opening mechanism to open the first container by moving the first opening mechanism towards and into the first container, and the second contents of the second container are at least in part evacuated therefrom upon activation of the second opening mechanism to open the second container by moving the second opening mechanism towards and into the second container, with the contents of both the first and second containers exiting the housing through the outlet with water from the water source; and wherein the first and second opening mechanism are a single device or multiple devices.

15. The apparatus of claim 14, wherein the first and second receptacles are in direct communication with the outlet.

16. The apparatus of claim 14, wherein the pump moves water from the water source to the vicinity of the openings formed in the first and second containers to exit the housing through the outlet.

17. A method for making a mixed drink comprising:

depositing a first single-serve container having a first contents into a housing;

depositing a second single-serve container having a second contents into the housing;

opening the first and second containers to permit the first and second contents to at least in part exit the containers;

pumping water from a water reservoir to mingle with the contents of the first and second containers;

allowing the mingled contents of the first and second containers and the water to exit the housing, wherein the opening of the first and second containers is performed by an opening mechanism in the form of a blade that slices the first and second containers by moving towards and into the first and second containers.

* * * * *